US010301810B2

(12) United States Patent
Lowe

(10) Patent No.: US 10,301,810 B2
(45) Date of Patent: May 28, 2019

(54) CLEAN-SPOT APPARATUS

(71) Applicant: Edward F. Lowe, Spanish Fort, AL (US)

(72) Inventor: Edward F. Lowe, Spanish Fort, AL (US)

( * ) Notice: Subject to any disclaimer, the term of this patent is extended or adjusted under 35 U.S.C. 154(b) by 170 days.

(21) Appl. No.: 14/631,482

(22) Filed: Feb. 25, 2015

(65) Prior Publication Data

US 2015/0240469 A1 Aug. 27, 2015

Related U.S. Application Data

(60) Provisional application No. 61/944,220, filed on Feb. 25, 2014.

(51) Int. Cl.
*E03D 13/00* (2006.01)

(52) U.S. Cl.
CPC ..... *E03D 13/005* (2013.01)

(58) Field of Classification Search
CPC ..... E03D 13/005
USPC ..... 4/301, 621
See application file for complete search history.

(56) References Cited

U.S. PATENT DOCUMENTS

| | | | | |
|---|---|---|---|---|
| 4,285,075 A | 8/1981 | Nelson | | |
| 7,904,972 B2 | 3/2011 | Anderson | | |
| 8,236,402 B1 | 8/2012 | Stickler et al. | | |
| 2006/0029773 A1 | 2/2006 | Waterman et al. | | |
| 2006/0179559 A1* | 8/2006 | Palazzolo | A47K 17/028 | 4/254 |
| 2015/0225937 A1* | 8/2015 | Brown | E03D 13/005 | 4/251.1 |

FOREIGN PATENT DOCUMENTS

| | | | |
|---|---|---|---|
| JP | H08266449 | A | 10/1996 |
| JP | 2006249747 | A | 9/2006 |
| JP | 2010075654 | A | 4/2010 |
| KR | 20020030733 | A | 4/2002 |
| KR | 20120094993 | A | 8/2012 |

OTHER PUBLICATIONS

International Search Report and Written Opinion for corresponding Int'l Application No. PCT/US2015/017547, dated May 21, 2015, 6 pages.

* cited by examiner

*Primary Examiner* — Tuan N Nguyen
(74) *Attorney, Agent, or Firm* — Quarles & Brady LLP

(57) ABSTRACT

A clean-spot apparatus for improving the cleanliness and hygienic conditions in a restroom is disclosed. In one example, the clean-spot apparatus can include an elevated platform supported by a support structure, and a pair of recessed areas. A person using a restroom receptacle in the restroom can place their feet into the recessed areas and the elevated platform extended center section prevents urine from dripping/splashing inadvertently onto the restroom floor.

19 Claims, 28 Drawing Sheets

Cross Section A-A

CLEAN-SPOT APPARATUS

CROSS-REFERENCE TO RELATED APPLICATION

The present application is based on, claims priority to, and incorporates herein by reference in its entirety, U.S. Provisional Patent Application No. 61/944,220, filed Feb. 25, 2014, and entitled "Clean-Spot Apparatus to Improve Hygiene in Restrooms."

STATEMENT OF FEDERALLY SPONSORED RESEARCH OR DEVELOPMENT

Not applicable.

TECHNICAL FIELD

This invention relates generally to a device which improves hygiene in a restroom and, more specifically, to a clean-spot apparatus capable of preventing urine from being inadvertently dripped/splashed onto the restroom floor.

BACKGROUND

Typically, when a person is using a restroom there is a high probability of urine dripping/splashing inadvertently onto the restroom floor. This requires frequent cleaning of the restroom floor. Additionally, the inadvertent dripping/splashing causes unpleasant and unsanitary hygienic conditions for the next person(s) using the restroom. Existing designs are floor mats and only provide a way of absorbing or concealing urine that drips onto the floor surface level.

Hence, a need exists for keeping restroom floors clean between normal restroom cleaning intervals thereby improving the hygienic conditions in the restroom.

SUMMARY

The aforementioned shortcomings are overcome by providing a clean-sport apparatus for improving cleanliness and hygienic conditions in a restroom by covering a person's feet on a restroom floor at a restroom receptacle such as a urinal or a toilet. The disclosed apparatus, in various forms, intercepts any liquid drops and prevents them from ever reaching the floor surface level where the user would stand.

In one aspect, the present disclosure provides a clean-spot apparatus including an elevated platform supported by a support structure. The elevated platform has an upper surface arranged substantially parallel to the restroom floor when the clean-spot apparatus is positioned in a usage position relative to the restroom receptacle. The clean-spot apparatus further includes a pair of recessed areas formed on a forwardly-facing side of the elevated platform such that, when a person approaches the clean-spot apparatus for use of the restroom receptacle and places their feet into the pair of recessed areas, the elevated platform covers and protects their feet and the restroom floor.

In some embodiments, the clean-spot apparatus may include an extended portion arranged between the pair of recessed areas on the forwardly-facing side and extending forwardly beyond the recessed areas.

In some embodiments, the clean-spot apparatus may include an absorbent pad supported by the upper surface of the elevated platform. The absorbent pad may include an impermeable film arranged between the absorbent pad and the elevated platform. The impermeable film may provide a seal between the absorbent pad and the elevated platform preventing the transmission of fluid onto the elevated platform. The absorbent pad may be pre-treated with a deodorizer. The absorbent pad may include at least one pull tab attached to the absorbent pad.

In some embodiments, the clean-spot apparatus may include an integrated wall-mounting assembly configured to attach the clean-spot apparatus to a wall and position the elevated platform substantially below the restroom receptacle. The integrated wall-mounting assembly may include an upper flange, a pair of stiffener gussets, and a wall-bearing panel. The upper flange may be configured to receive at least one fastener element to attach the clean-spot apparatus to the wall. The pair of stiffener gussets may extend from the elevated platform to the wall-bearing panel.

In some embodiments, the clean-spot apparatus may include a cutout portion formed on a rearwardly-facing side opposite to the forwardly-facing side and dimensioned to receive the restroom receptacle. The clean-spot apparatus may include a support channel arranged along the cutout portion and configured to bond the clean-spot apparatus to the restroom receptacle.

In some embodiments, the clean-spot apparatus may include a cutout portion dimensioned to frame the restroom receptacle. The elevated platform may include at least one ramped portion ramping from the elevated platform downwardly towards the restroom receptacle.

In some embodiments, the elevated platform may be arranged substantially perpendicular to the support structure. The support structure may include at least one column type support. The support structure may be a continuous panel section framing the elevated platform.

In some embodiments, the pair of recessed areas may define a substantially concave shape.

In some embodiments, the elevated platform and the support structure may be fabricated from a plastic material. The plastic material may be a high impact resistant material. However, the support structure may also be fabricated from any suitable material known in the art. In some embodiments, an elastic pad may be received on the underside of the support structure for placement between support structure and the restroom floor.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION

FIGS. 1A-6D illustrate a plurality of non-limiting examples of a clean-spot apparatus received in a restroom. As will be described, the clean-spot apparatus can be configured or designed to be used with a plurality of restroom receptacles. Although each of the plurality of non-limiting examples of the clean-spot apparatus will be described with reference to use with a specific restroom receptacle, it should be appreciated that any of the non-limiting examples of the clean-spot apparatus described herein could be configured for use with any restroom receptacle known in the art. Thus, the illustrated restroom receptacles and clean-spot apparatuses are exemplary in nature, but not limiting.

Figure 1A:
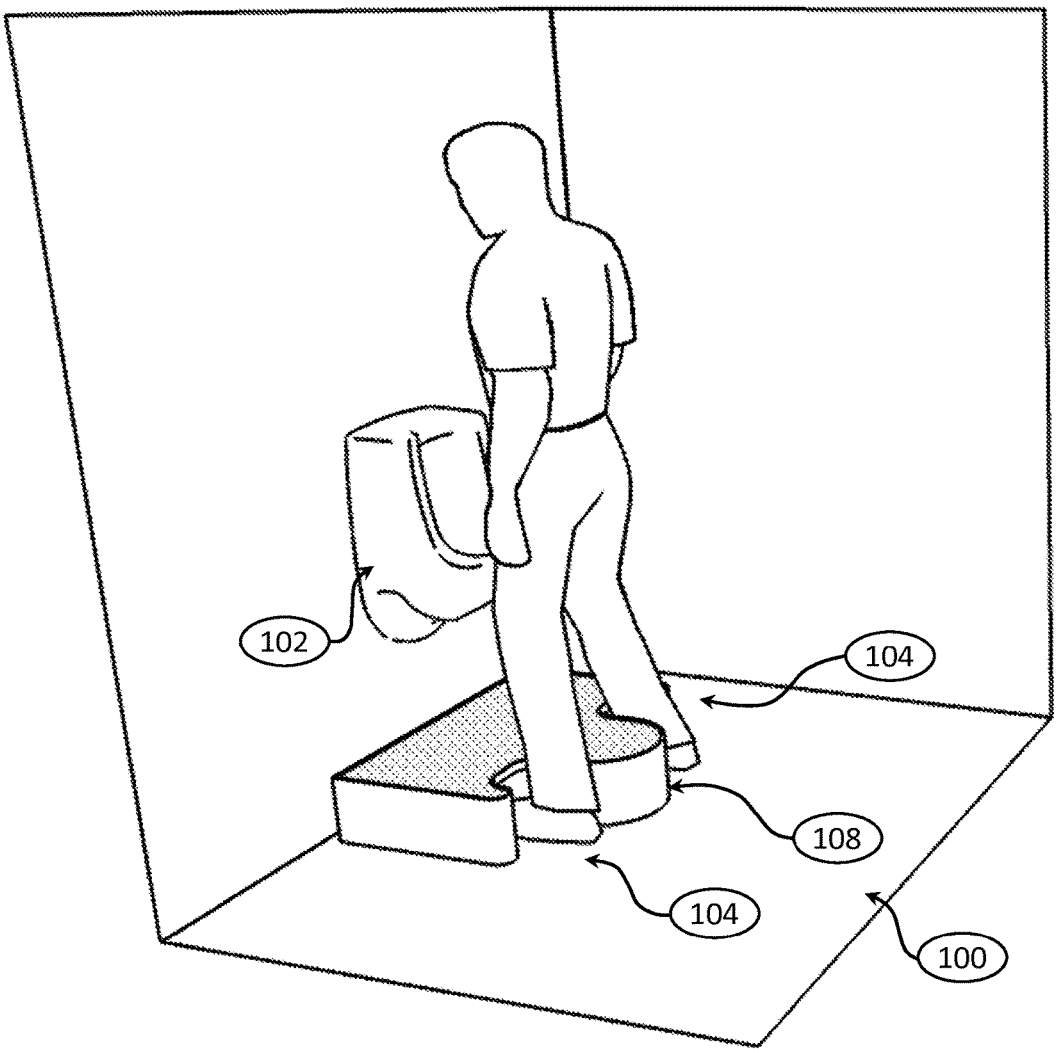
FIG. 1A is a perspective view illustrating a use of a floor-supported clean-spot apparatus in accordance with one embodiment of the present disclosure.
Figure 1B:
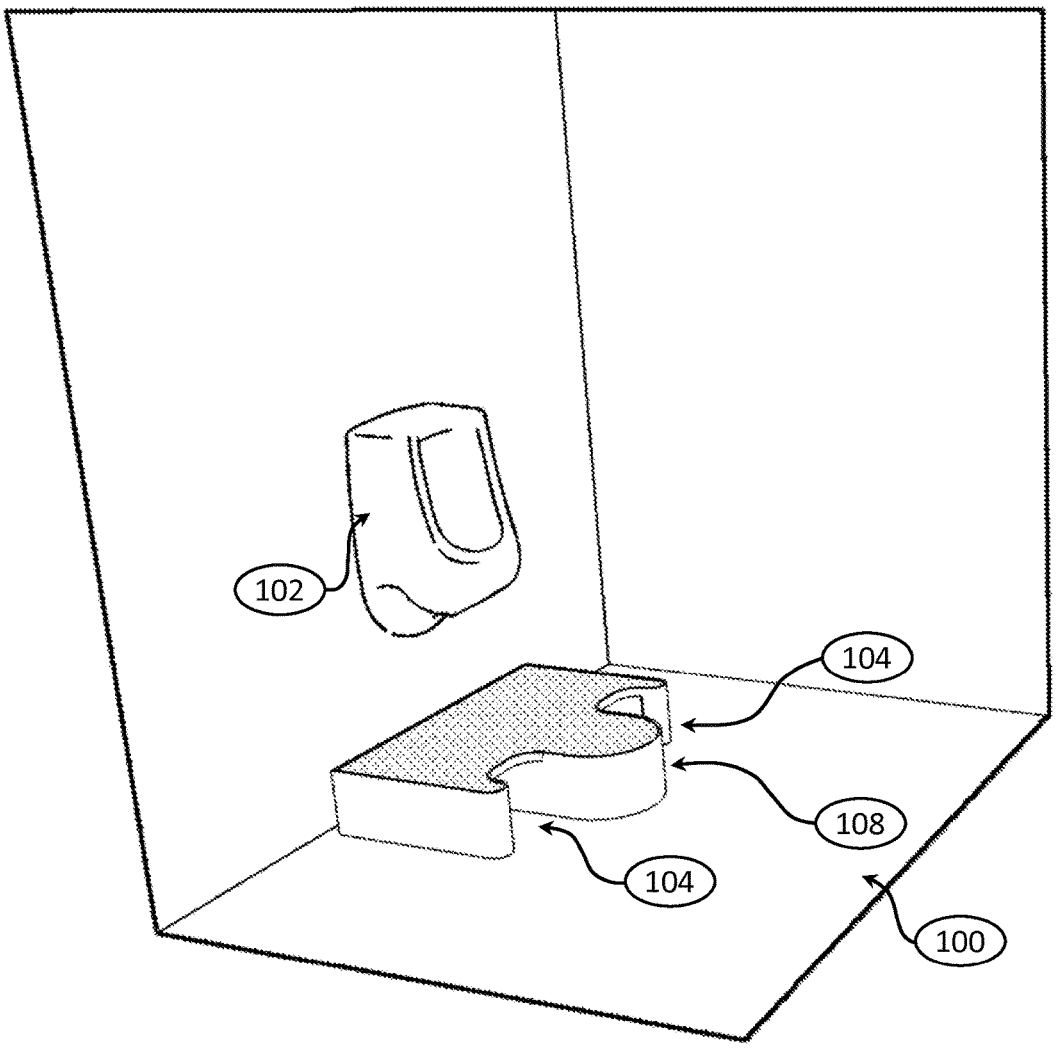
FIG. 1B is a perspective view of the clean-spot apparatus of FIG. 1A.

FIGS. 1A-1F show one non-limiting example of a clean-spot apparatus 100. As shown in FIG. 1A and FIG. 1B, the clean-spot apparatus 100 can be configured to be mounted on a restroom floor substantially below a wall-mounted urinal 102. Since the clean-spot apparatus 100 can be received on the restroom floor, no tools are required for installation, and the clean-spot apparatus 100 can be easily moved for cleaning of the restroom floor.

The clean-spot apparatus 100 can include a pair of recessed areas 104, an extended portion 108, an elevated platform 112, and a support structure 116. The recessed areas 104 can be formed on separate ends of a forwardly-facing side of the elevated platform 112 and can define a substantially concave shape. The forwardly-facing side can be opposed to a rearwardly-facing side of the elevated platform 112. The rearwardly-facing side can be, for example, in engagement with the restroom wall. The recessed areas 104 can be dimensioned to receive a person's feet, thereby enabling the person to stand close to the wall-mounted urinal 102 while covering and protecting the person's feet with the elevated platform 112. The elevated platform 112 can include an upper surface that, when the clean-spot apparatus 100 is arranged in a usage position adjacent to the urinal 102, as shown in FIGS. 1A and 1B, the upper surface is arranged to be substantially parallel to the restroom floor. The elevated platform 112 can enable the clean-spot apparatus 100 to intercept splashing/dripping urine while keeping the person's feet and the restroom floor clean. The extended portion 108 can be arranged between the recessed areas 104 on the forwardly-facing side of the elevated platform 112 and can extend forwardly (i.e., in a direction away from the wall) beyond the recessed areas 104. The extended portion 108 can provide a large area between the person's feet for intercepting splashing/dripping urine.

Figure 1C:
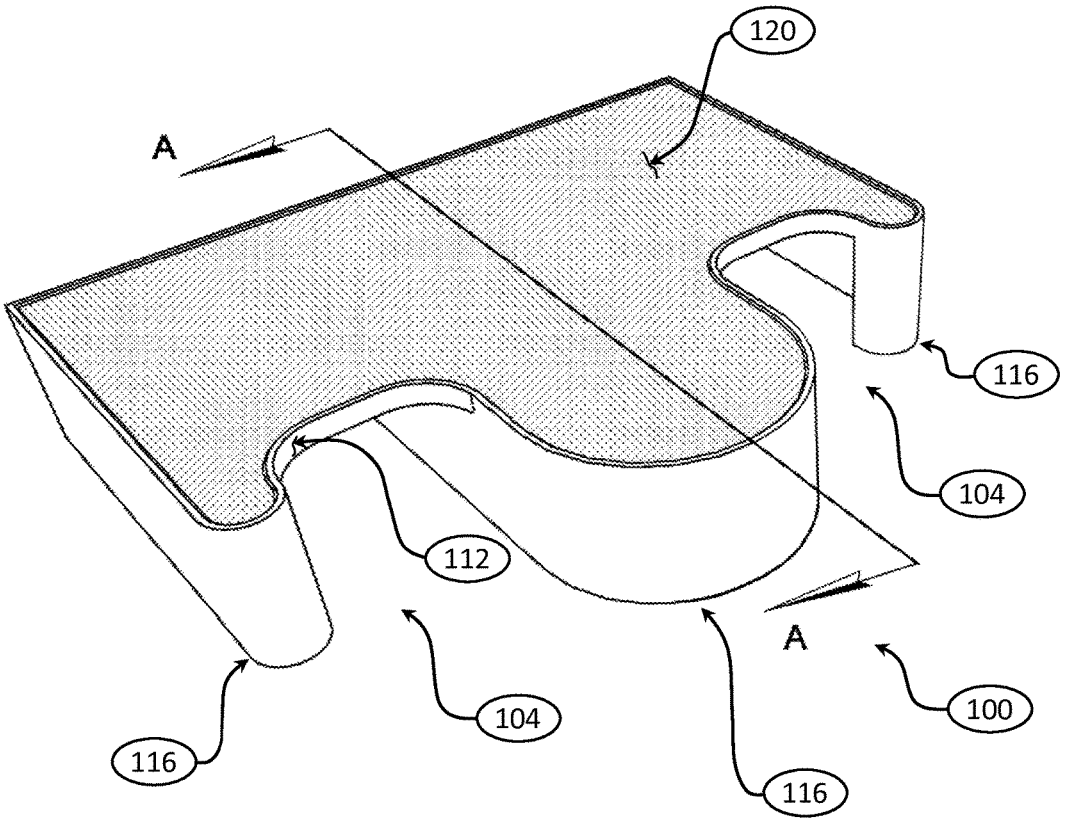
FIG. 1C is a close-up perspective view of the clean-spot apparatus of FIG. 1A.
Figure 1D:
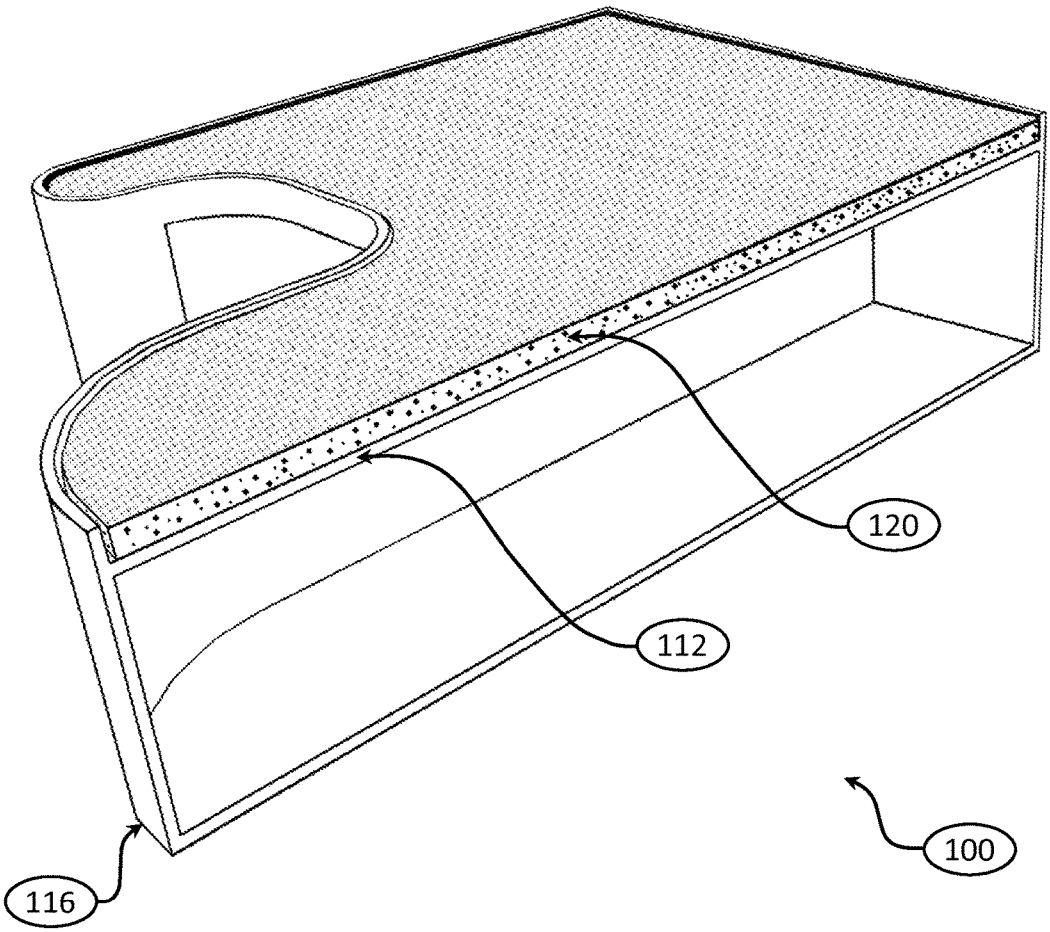
FIG. 1D is a cross-sectional view of the clean-spot apparatus of FIG. 1A taken through line A-A of FIG. 1C.

With reference to FIG. 1C and FIG. 1D, the upper surface of the elevated platform 112 can support an absorbent pad 120. When the clean-spot apparatus 100 is positioned substantially below the wall-mounted urinal 102, the absorbent pad 120 can intercept splashing/dripping urine before it contacts the restroom floor. The absorbent pad 120 can be made of a material that has color and texture that makes the appearance of drops less visible or apparent to an observer. It is also contemplated that the absorbent pad could be formed in one part or as two or more parts. For example, dotted line 107 in FIG. 1F marks one line at which the pad 120 could be bifurcated. Having a multi-part pad may be particularly advantageous because if, for example, the pad is divided to include a separate section in the extended center section of the apparatus (which is typically the most quickly soiled given its placement), then only the part of the pad in the extended center section may be replaced instead of the entirety of the pad which may provide better economy during replacement of a used pad.

The elevated platform 112 can be mounted on or supported on the support structure 116 that supports the elevated platform 112 above the restroom floor. As shown in FIG. 1D, the elevated platform 112 can be arranged substantially perpendicular to the support structure 116. In the illustrated, non-limiting example, the support structure 116 can support the elevated platform 112 approximately 6 inches above the restroom floor. In other non-limiting configurations, the support structure 116 can support the elevated platform 112 at any distance from the restroom floor, as desired.

The support structure 116 and the elevated platform 112 may be integrally formed as in a monolithic form, or they may be provided by separable components. In some forms, the support structure 116 may be a continuous panel section framing the elevated platform 112 and/or, the support structure 116 may include at least one discrete column type support.

The elevated platform 112 and the support structure 116 can be fabricated from a plastic material, for example, a high impact resistant plastic material. In other non-limiting examples, the elevated platform 112 and/or the support structure 116 may be fabricated from any suitable material known in the art. The support structure 116 can include at least one elastic pad (not shown) arranged between support structure 116 and the restroom floor aiding in preventing the clean-spot apparatus 100 from sliding along the restroom floor.

Figure 1E:
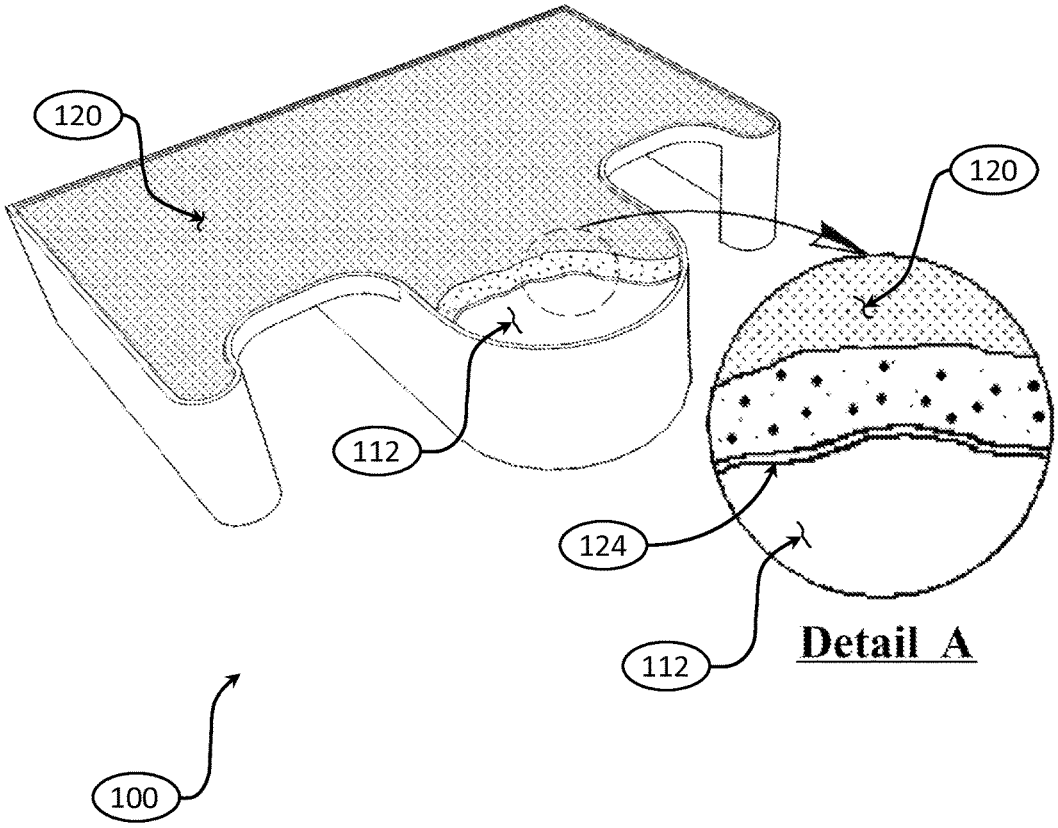
FIG. 1E is a perspective view of the clean-spot apparatus of FIG. 1A detailing an absorbent pad of the clean-spot apparatus with a portion of the absorbent pad broken away.

With reference to FIG. 1E, the absorbent pad 120 can include an impermeable film 124 arranged between the absorbent pad 120 and the elevated platform 112. The impermeable film 124 can provide a seal between the absorbent pad 120 and the elevated platform 112 preventing transmission of fluid onto the elevated platform 112. In one non-limiting example, the absorbent pad 120 may be pre-treated with a deodorizer.

Figure 1F:
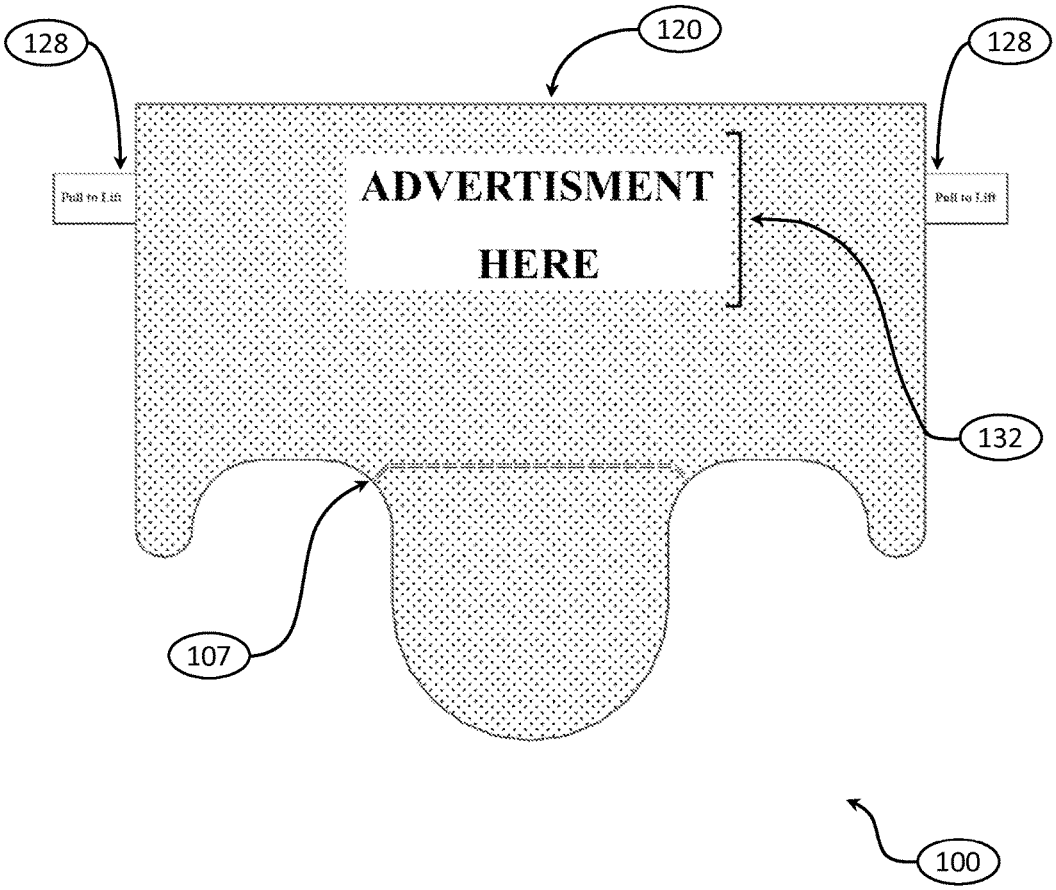
FIG. 1F is a top view of the absorbent pad of the clean-spot apparatus of FIG. 1A.

As shown in FIG. 1F, the absorbent pad 120 can include a pair of lift tabs 128 attached on opposing sides of the absorbent pad 120. The lift tabs 128 may be used to install the absorbent pad 120 onto the elevated platform 112 and/or remove the absorbent pad 120 from the elevated platform 112. A printed advertisement 132 may be displayed on the absorbent pad 120.

Figure 2A:
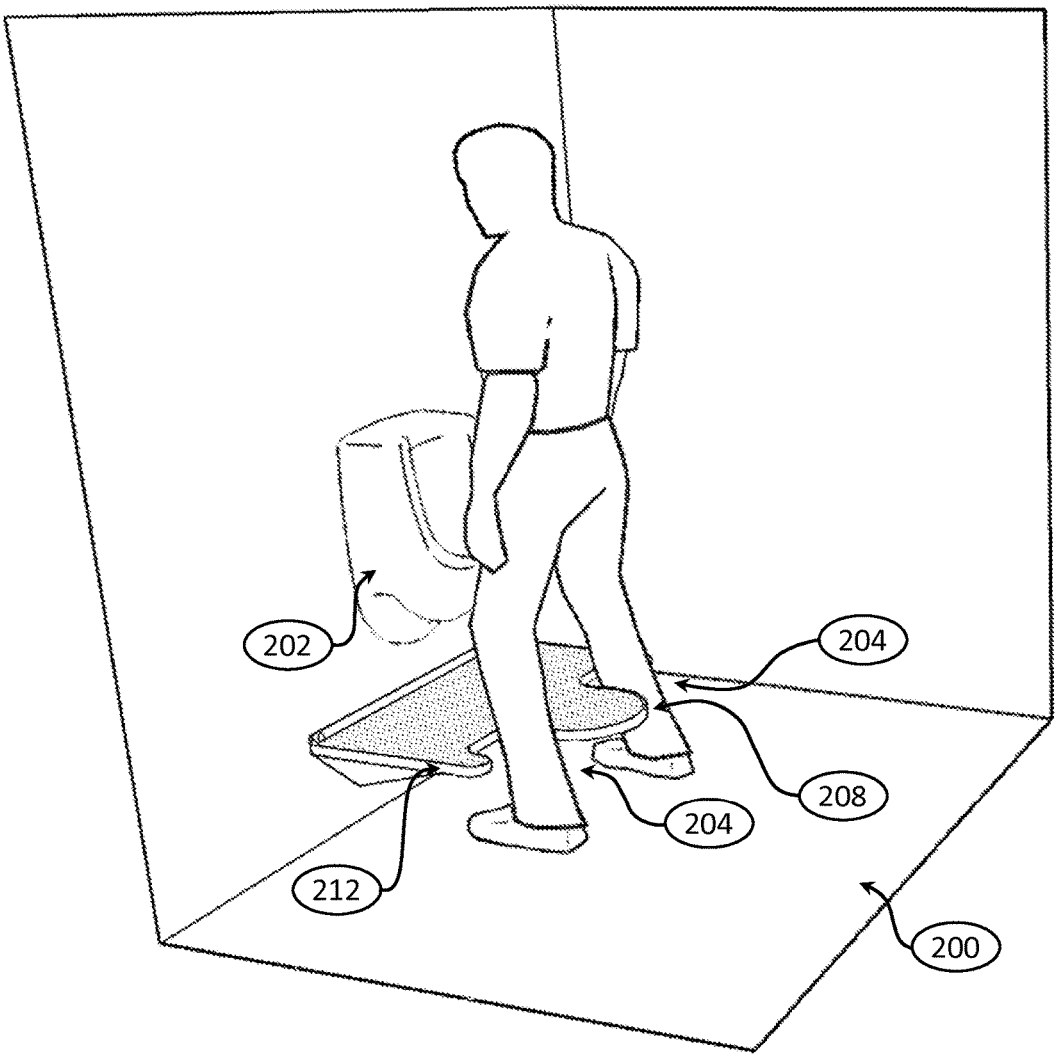
FIG. 2A is a perspective view illustrating a use of a wall-mounted clean-spot apparatus with a wall-mounted urinal in accordance with another embodiment of the present disclosure.
Figure 2B:
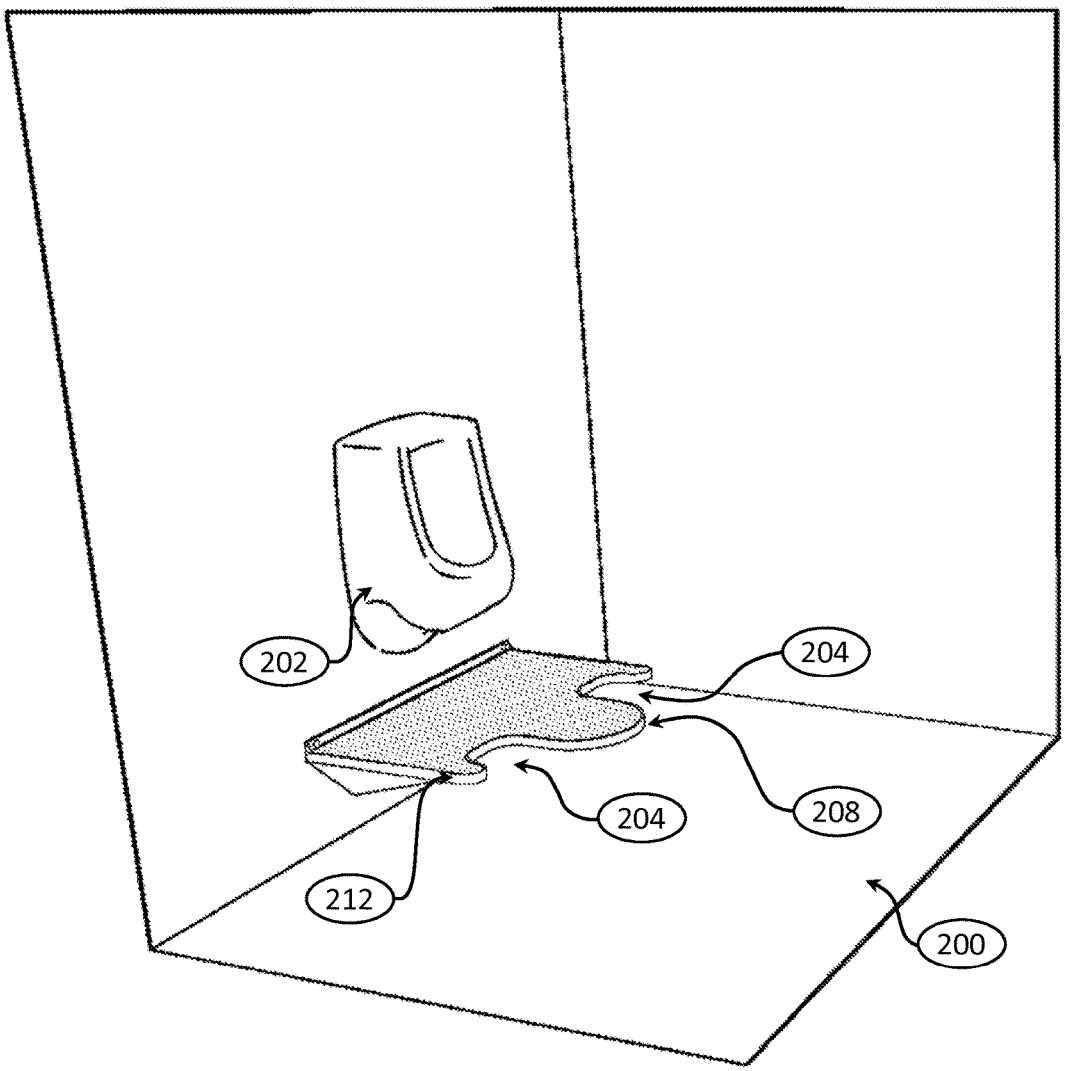
FIG. 2B is a perspective view of the clean-spot apparatus of FIG. 2A.

FIGS. 2A-2D show another non-limiting example of a clean-spot apparatus 200. As shown in FIG. 2A and FIG. 2B, the clean-spot apparatus 200 can be configured to be mounted on a restroom wall substantially below a wall-mounted urinal 202. Since the clean-spot apparatus 200 is mounted on the restroom wall and suspended above the restroom floor, the clean-spot apparatus 200 provides easy access for cleaning the restroom floor below the wall-mounted urinal 202.

The clean-spot apparatus 200 can include a pair of recessed areas 204, an extended portion 208, and an elevated platform 212. The recessed areas 204 can be formed on separate ends of a forwardly-facing side of the elevated platform 212 and can define a substantially concave shape. The forwardly-facing side can be opposed to a rearwardly-facing side of the elevated platform 212. The rearwardly-facing side can be in mounted engagement with the restroom wall. The recessed areas 204 can be dimensioned to receive a person's feet thereby enabling the person to stand close to the wall-mounted urinal 202 while covering and protecting the person's feet with the elevated platform 212. The elevated platform 212 can include an upper surface that, when the clean-spot apparatus 200 is arranged in a usage position as shown in FIGS. 2A and 2B in which the clean-spot apparatus 200 is under the urinal 202, the upper surface can be arranged substantially parallel to the restroom floor. The elevated platform 212 can enable the clean-spot apparatus 200 to intercept splashing/dripping urine while keeping the person's feet and the restroom floor clean. The extended portion 208 can be arranged between the recessed areas 204 on the forwardly-facing side of the elevated platform 212 and can extend forwardly beyond the recessed areas 204. The extended portion 208 can provide a large area between the person's feet for intercepting splashing/dripping urine.

Figure 2C:
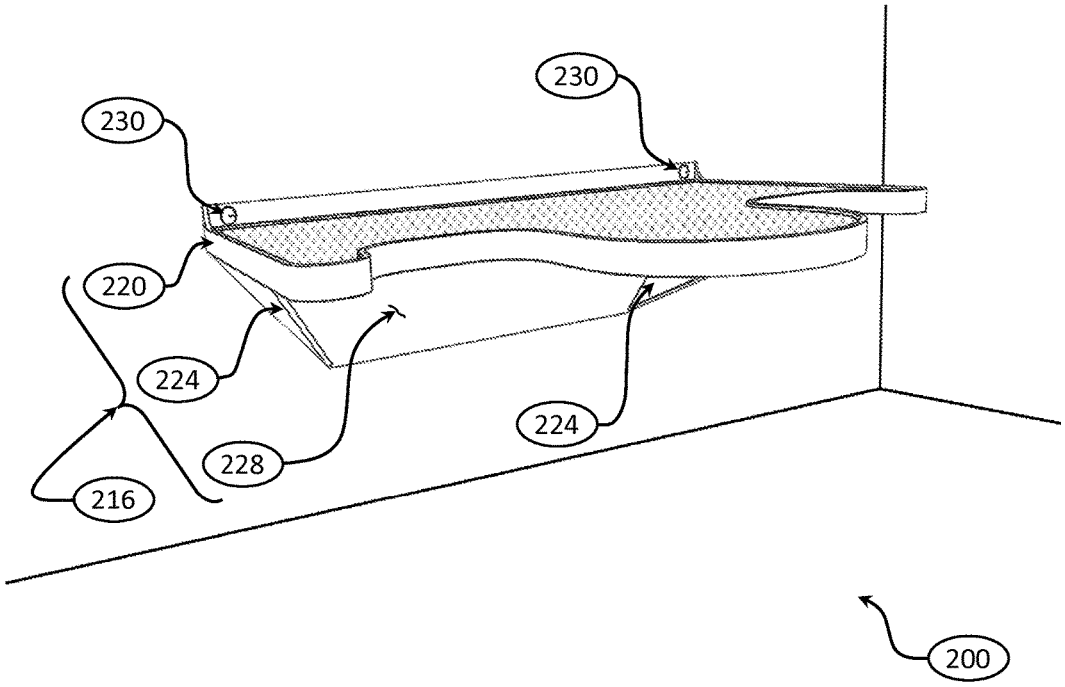
FIG. 2C is a close-up perspective view of the clean-spot apparatus of FIG. 2A showing a method of attachment.

With reference to FIG. 2C, the clean-spot apparatus 200 can be attached to the restroom wall using an integrated wall-mounting assembly 216. The integrated wall-mounting assembly 216 can include an upper flange 220, a pair of stiffener gussets 224, and a wall-bearing panel 228. The upper flange 220 can extend substantially perpendicularly from the elevated platform 212 toward the wall-mounted urinal 202 and can be arranged to engage the restroom wall. The pair of stiffener gussets 224 can be arranged on opposing sides of the elevated platform 212 and can extend from the elevated platform 212 to the wall-bearing panel 228. The wall-bearing panel 228 can extend substantially perpendicularly from the elevated platform 212 in an opposite direction from the upper flange 220 and can be arranged to engage the restroom wall.

In the illustrated non-limiting example, the upper flange 220 can be configured to receive two fastener elements 230 used to attach the clean-spot apparatus 200 to the restroom wall. In other non-liming configurations, the upper flange 220 may be configured to receive more or less fastener elements 230, as desired. It should be appreciated that the illustrated integrated wall-mounting assembly 216 is just one way of attaching the clean-spot apparatus 200 to the restroom wall and, in other non-limiting examples, the clean-spot apparatus 200 can be attached to the restroom wall using any viable attachment method known in the art.

The elevated platform 212 and the integrated wall-mounting assembly 216 can be fabricated from a plastic material, for example, a high impact resistant plastic material. In other non-limiting examples, the elevated platform 212 and/or the integrated wall-mounting assembly 216 may be fabricated from any suitable material known in the art.

Figure 2D:
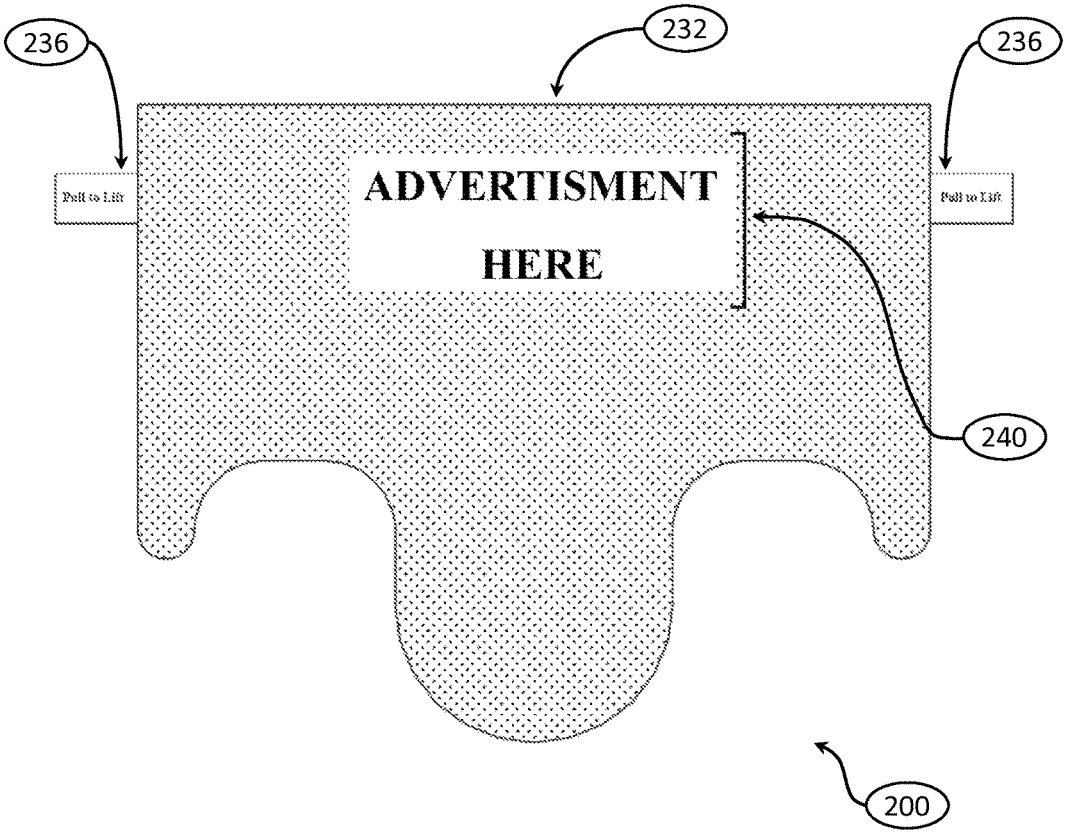
FIG. 2D is a top view of the absorbent pad of the clean-spot apparatus of FIG. 2A.

With reference to FIG. 2D, the upper surface of the elevated platform 212 can support an absorbent pad 232. When the clean-spot apparatus 200 is positioned substantially below the wall-mounted urinal 202, the absorbent pad 232 can intercept splashing/dripping urine before it contacts the restroom floor. The absorbent pad 232 can include an impermeable film (not shown, but described earlier) arranged between the absorbent pad 232 and the elevated platform 212. The impermeable film can provide a seal between the absorbent pad 232 and the elevated platform 212 preventing transmission of fluid onto the elevated platform 212. In one non-limiting example, the absorbent pad 232 may be pre-treated with a deodorizer.

The absorbent pad 232 can include a pair of lift tabs 236 attached on opposing sides of the absorbent pad 232. The lift tabs 236 may be used to install the absorbent pad 232 onto the elevated platform 212 and/or remove the absorbent pad 232 from the elevated platform 212. A printed advertisement 240 may be displayed on the absorbent pad 232.

Figure 3A:
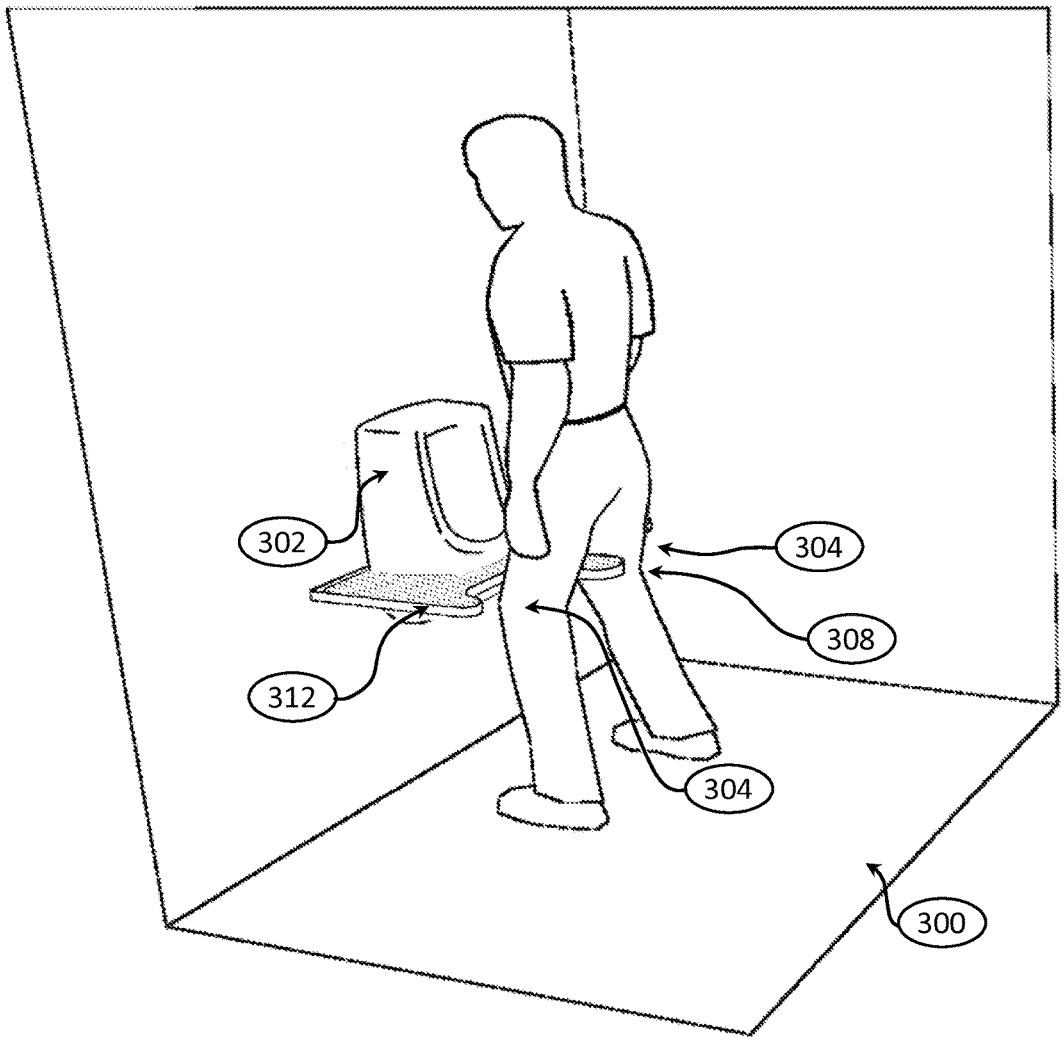
FIG. 3A is a perspective view illustrating a use of a urinal-supported clean-spot apparatus with wall-mounted urinal in accordance with another embodiment of the present disclosure.
Figure 3B:
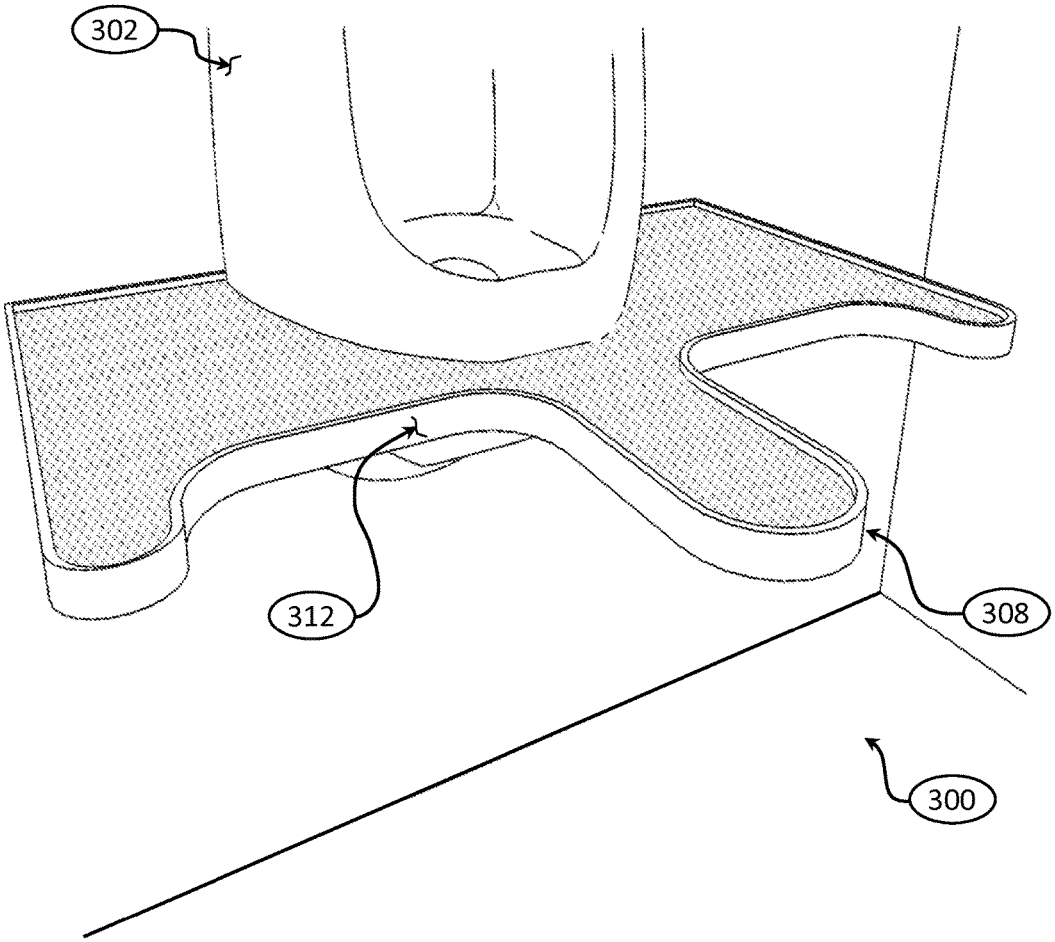
FIG. 3B is a close-up perspective view of the clean-spot apparatus of FIG. 3A.
Figure 3C:
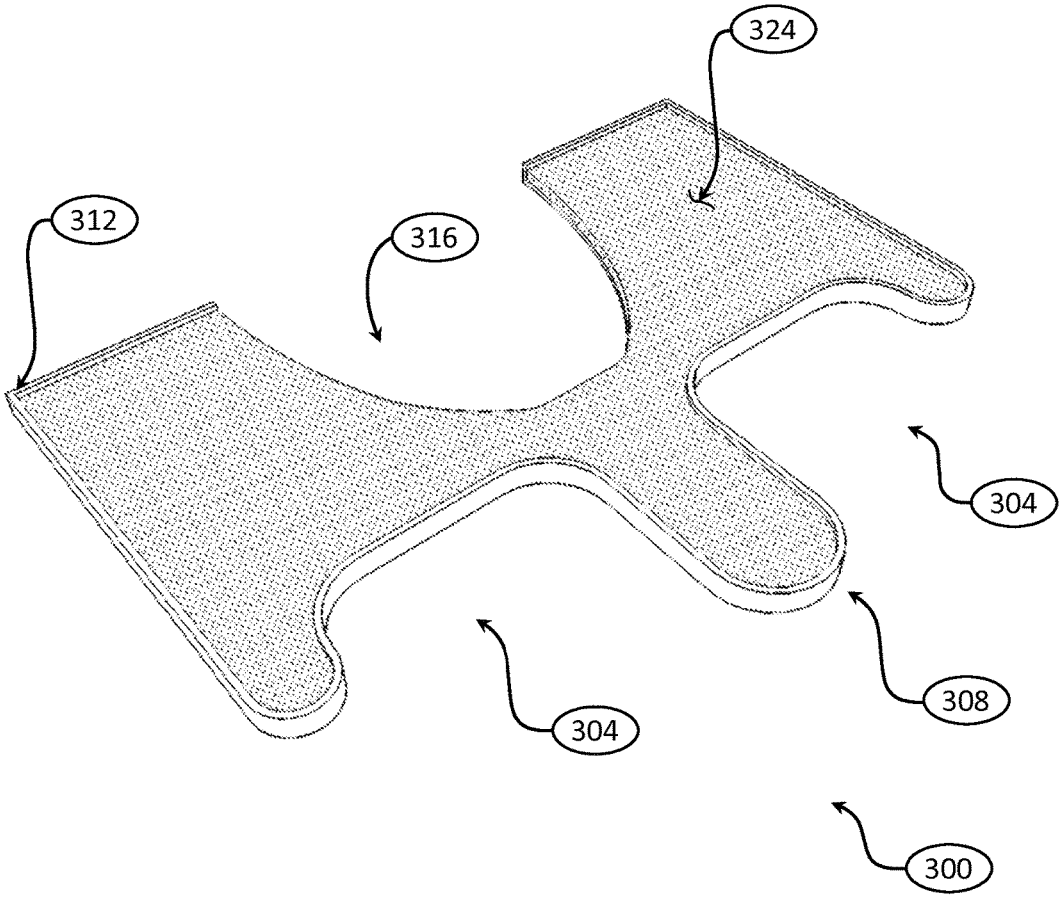
FIG. 3C is a perspective view of the clean-spot apparatus of FIG. 3A apart from the urinal.

FIGS. 3A-3F show another non-limiting example of a clean-spot apparatus 300. As shown in FIG. 3A, FIG. 3B, and FIG. 3C the clean-spot apparatus 300 can be configured to be mounted on a lower portion of a wall-mounted urinal 302. Since the clean-spot apparatus 300 is mounted on a lower portion of the wall-mounted urinal 302 and suspended above the restroom floor, the clean-spot apparatus 300 provides easy access for cleaning the restroom floor below the wall-mounted urinal 302.

The clean-spot apparatus 300 can include a pair of recessed areas 304, an extended portion 308, an elevated platform 312, and a cutout portion 316. The recessed areas 304 can be formed on separate ends of a forwardly-facing side of the elevated platform 312 and can define a substantially concave shape. The forwardly-facing side can be opposed to a rearwardly-facing side of the elevated platform 312. The rearwardly-facing side can be in engagement with the restroom wall and/or urinal 302. The recessed areas 304 can be dimensioned to receive a person's legs thereby enabling the person to stand close to the wall-mounted urinal 302 and covering the person's legs/feet with the elevated platform 312. The elevated platform 312 can include an upper surface that, when the clean-spot apparatus 300 is arranged in a usage position, as shown in FIGS. 3A and 3B, the upper surface can be arranged substantially parallel to the restroom floor. The elevated platform 312 can enable the clean-spot apparatus 300 to intercept splashing/dripping urine while keeping the person's legs/feet and the restroom floor clean. The extended portion 308 can be arranged between the recessed areas 304 on the forwardly-facing side of the elevated platform 312 and can extend forwardly beyond the recessed areas 304. The extended portion 308 can provide a large area between the person's legs for intercepting splashing/dripping urine. The cutout portion 316 can be formed on the rearwardly-facing side of the elevated platform 312 and can be dimensioned to receive the lower portion of the wall-mounted urinal 302. Although the cutout portion 316 in the illustrated non-limiting example is shown receiving a lower portion of a wall-mounted urinal, it should be appreciated that the cutout portion 316 could be dimensioned to receive any portion of any restroom receptacle.

Figure 3D:
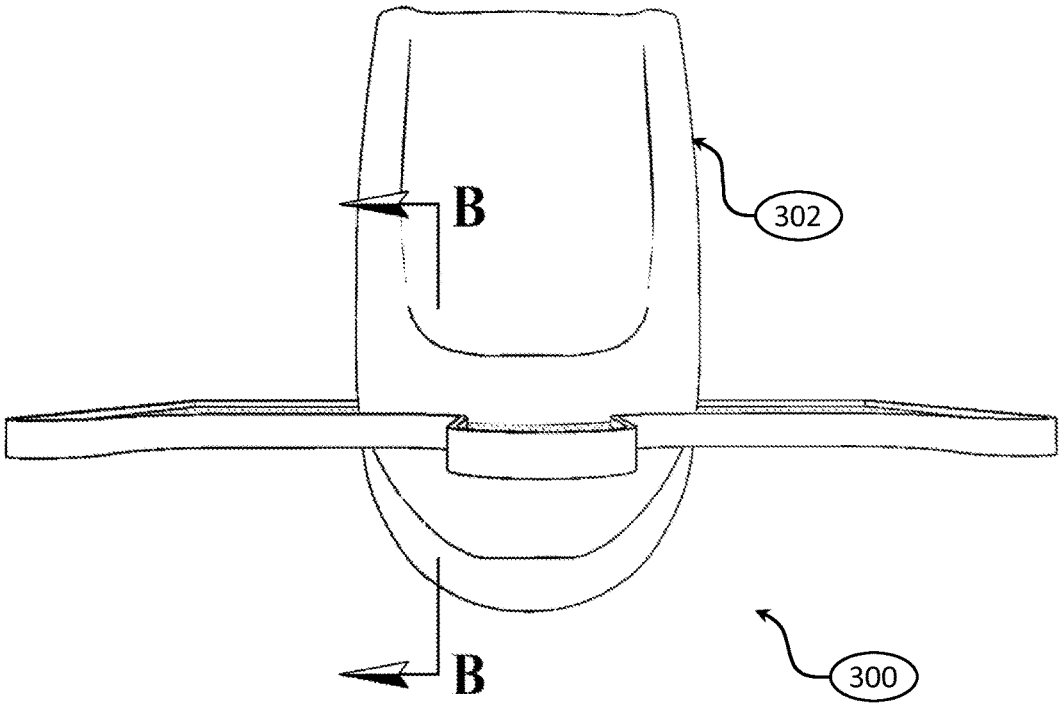
FIG. 3D is a front view of the clean-spot apparatus of FIG. 3A.
Figure 3E:
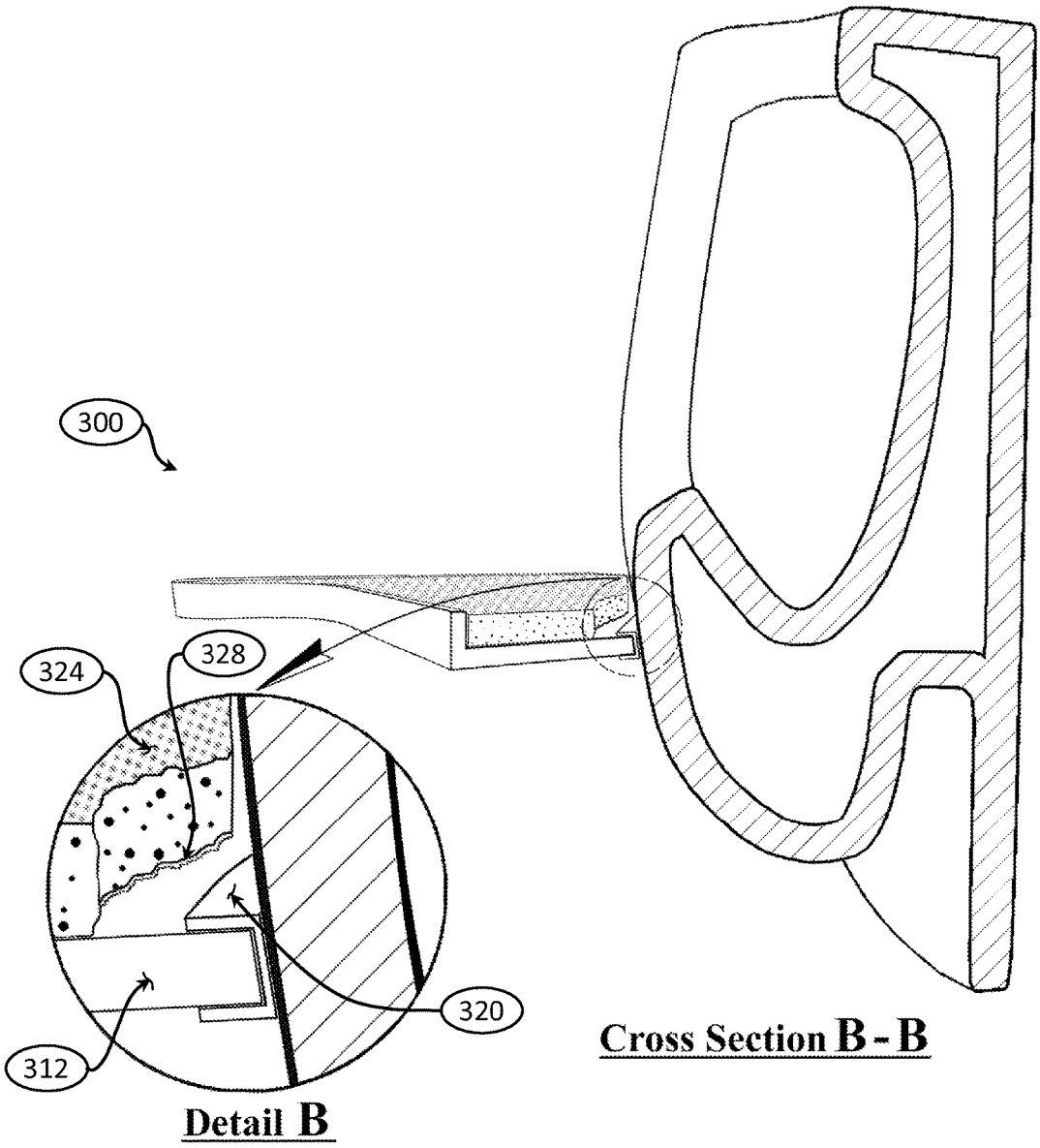
FIG. 3E is a cross sectional view of the clean-spot apparatus of FIG. 3A taken through line B-B of FIG. 3D with the details of the mounting structure.

With reference to FIG. 3D and FIG. 3E, the clean-spot apparatus 300 can be attached to the lower portion of the wall-mounted urinal 302 using a support channel 320. The support channel 320 can be arranged along the cutout portion 316 and is capable of bonding the cutout portion 316, and thereby the clean-spot apparatus 300, to the wall-mounted urinal 302. The support channel 320 may include an adhesive material capable of bonding the clean-spot apparatus 300 to the wall-mounted urinal 302. In other non-limiting configurations, the clean-spot apparatus 300 may be attached to the wall-mounted urinal 302 using any viable attachment method known in the art.

The elevated platform 312 and the support channel 320 can be fabricated from a plastic material, for example, a high impact resistant plastic material. In other non-limiting examples, the elevated platform 312 and/or the support channel 320 may be fabricated from any suitable material known in the art.

The upper surface of the elevated platform 312 can support an absorbent pad 324. When the clean-spot apparatus 300 is attached to the lower portion of the wall-mounted urinal 302, the absorbent pad 324 can intercept splashing/dripping urine before it contacts the restroom floor. The absorbent pad 324 can include an impermeable film 328 arranged between the absorbent pad 324 and the elevated platform 312. The impermeable film 328 can provide a seal between the absorbent pad 324 and the elevated platform 312 preventing transmission of fluid onto the elevated platform 312. In one non-limiting example, the absorbent pad 324 may be pre-treated with a deodorizer.

Figure 3F:
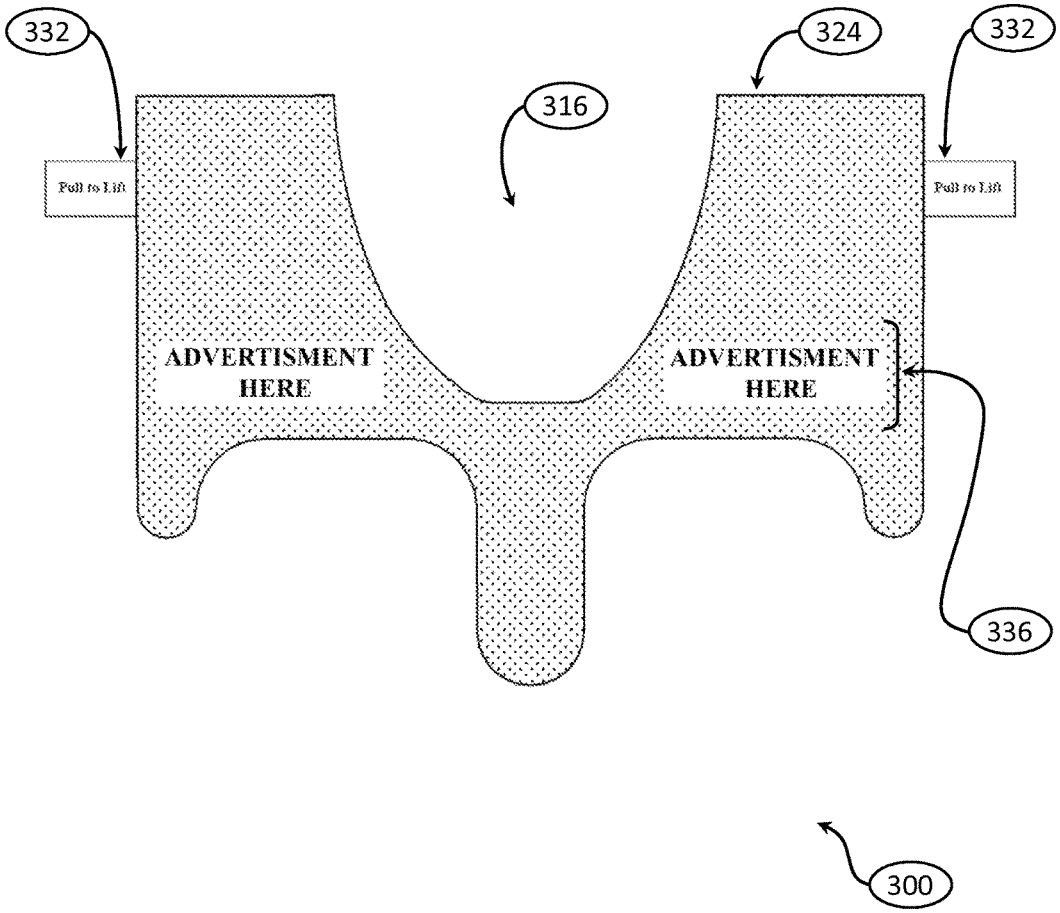
FIG. 3F is a top view of the clean-spot apparatus of FIG. 3A.

With reference to FIG. 3F, the absorbent pad 324 can include a pair of lift tabs 332 attached on opposing sides of the absorbent pad 324. The lift tabs 332 may be used to install the absorbent pad 324 onto the elevated platform 312 and/or remove the absorbent pad 324 from the elevated platform 312. A printed advertisement 336 may be displayed on the absorbent pad 324.

Figure 4A:
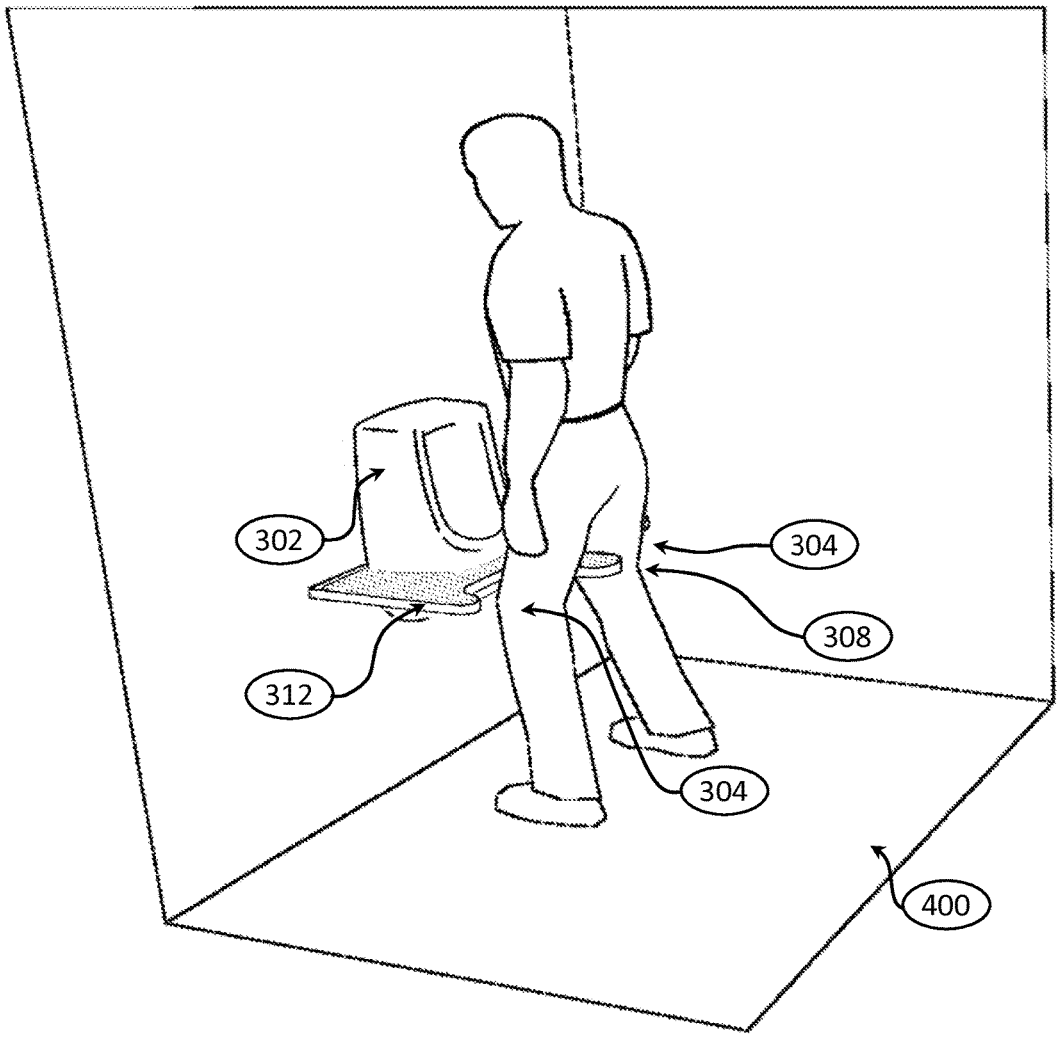
FIG. 4A is a perspective view illustrating a use of a urinal-integrated clean-spot apparatus with a wall-mounted urinal in accordance with another embodiment of the present disclosure.
Figure 4B:
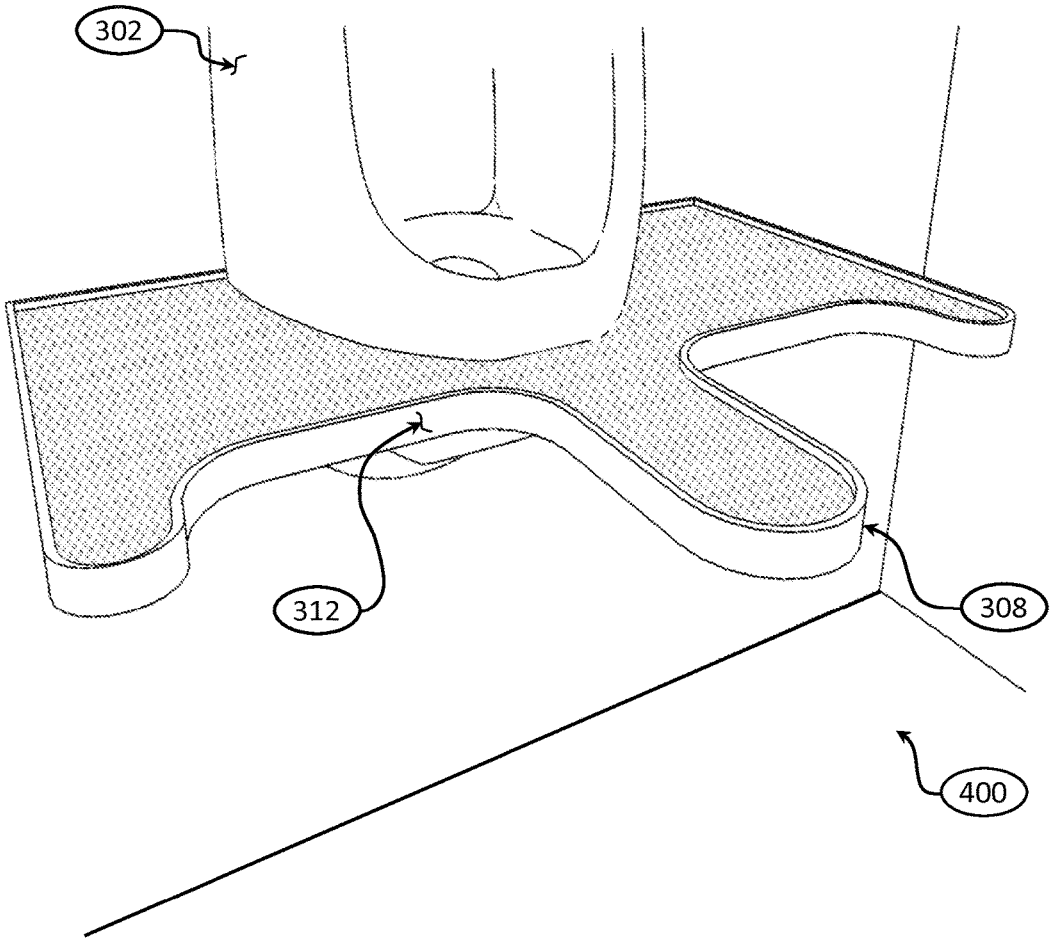
FIG. 4B is a close-up perspective view of the clean-spot apparatus of FIG. 4A.
Figure 4C:
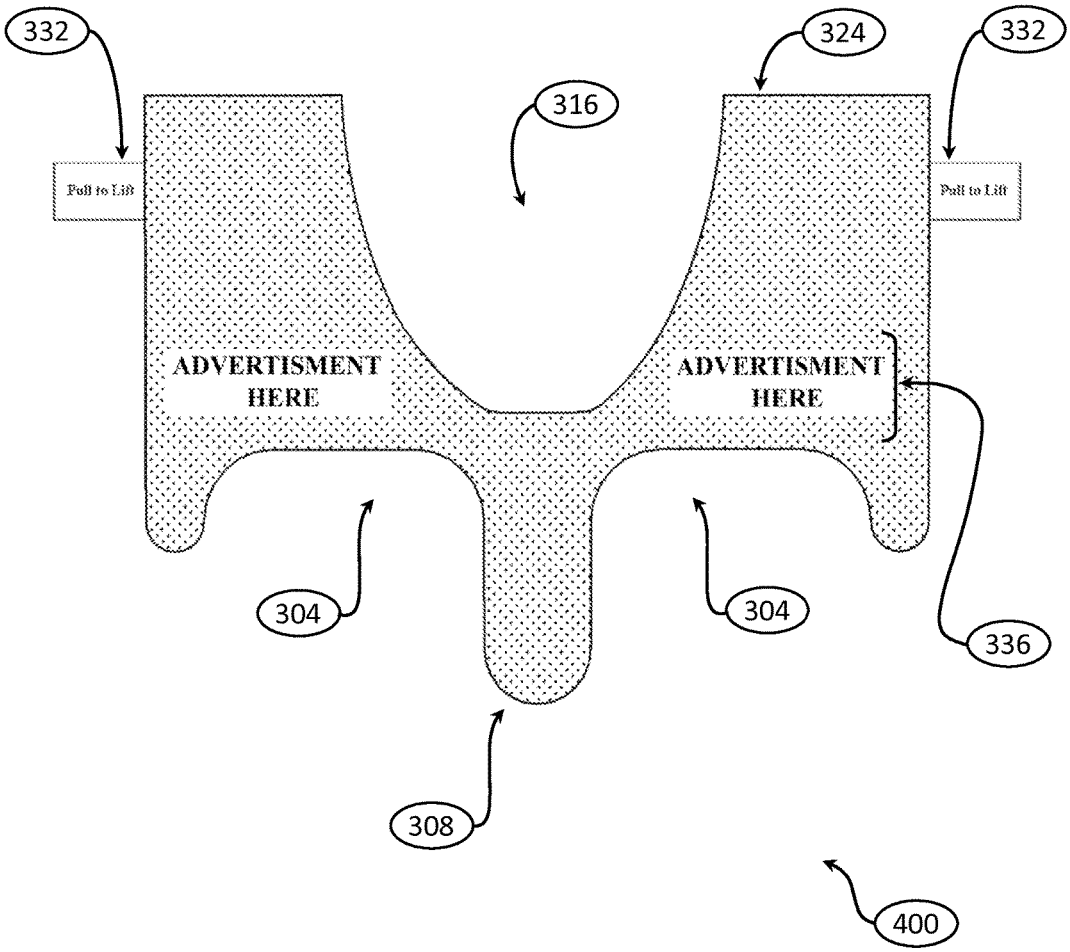
FIG. 4C is a top view of the absorbent pad of the clean-spot apparatus of FIG. 4A.

FIGS. 4A-4C show another non-limiting example of a clean-spot apparatus 400. The basic design, purpose, and function of the clean-spot apparatus 400 is substantially similar to the previously described clean-spot apparatus 300 mounted to the lower portion of the wall-mounted urinal 302. The similar features between the two non-limiting examples are identified with like reference numerals. The clean-spot apparatus 400 differs from the previously described clean-spot apparatus 300 in that the elevated platform 312 can be fabricated integrally with or designed as a mating component of the wall-mounted urinal 302. It is contemplated that the apparatus 400 can be made from the same material as the urinal (for example, ceramic or metal) and may be fabricated from any suitable material known in the art.

FIGS. 5A-5E show another non-limiting example of a clean-spot apparatus 500. As shown in FIG. 5A, FIG. 5B, FIG. 5C, and FIG. 5D, the clean-spot apparatus 500 can be configured to be mounted on a restroom floor and received by a lower portion of a floor level urinal 502. Since the clean-spot apparatus 500 can be received on the restroom floor, no tools are required for installation, and the clean-spot apparatus 500 can be easily moved for cleaning of the restroom floor.

Figure 5A:
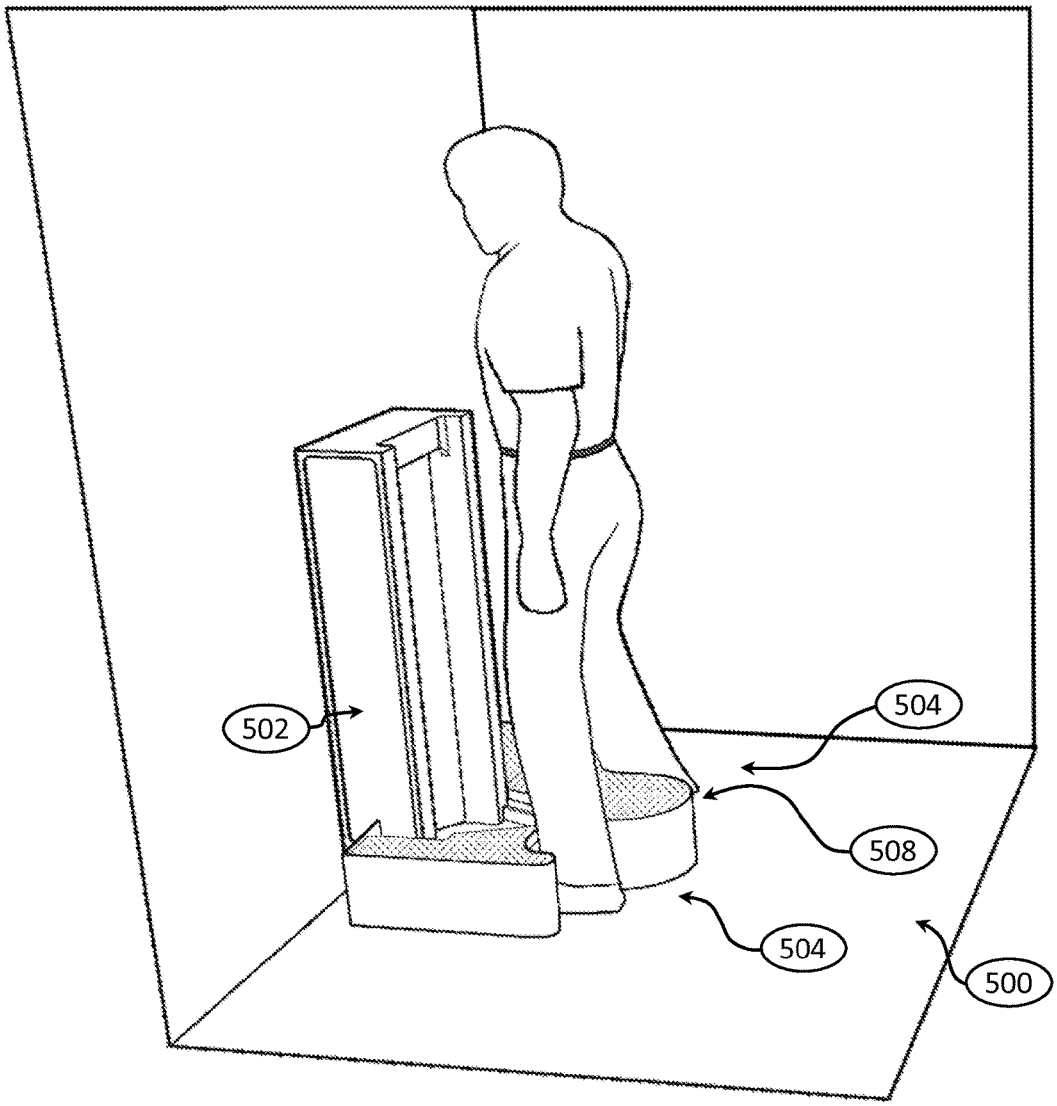
FIG. 5A is a perspective view illustrating a use of a floor-supported clean-spot apparatus with a wall/floor-supported urinal in accordance with another embodiment of the present disclosure.
Figure 5B:
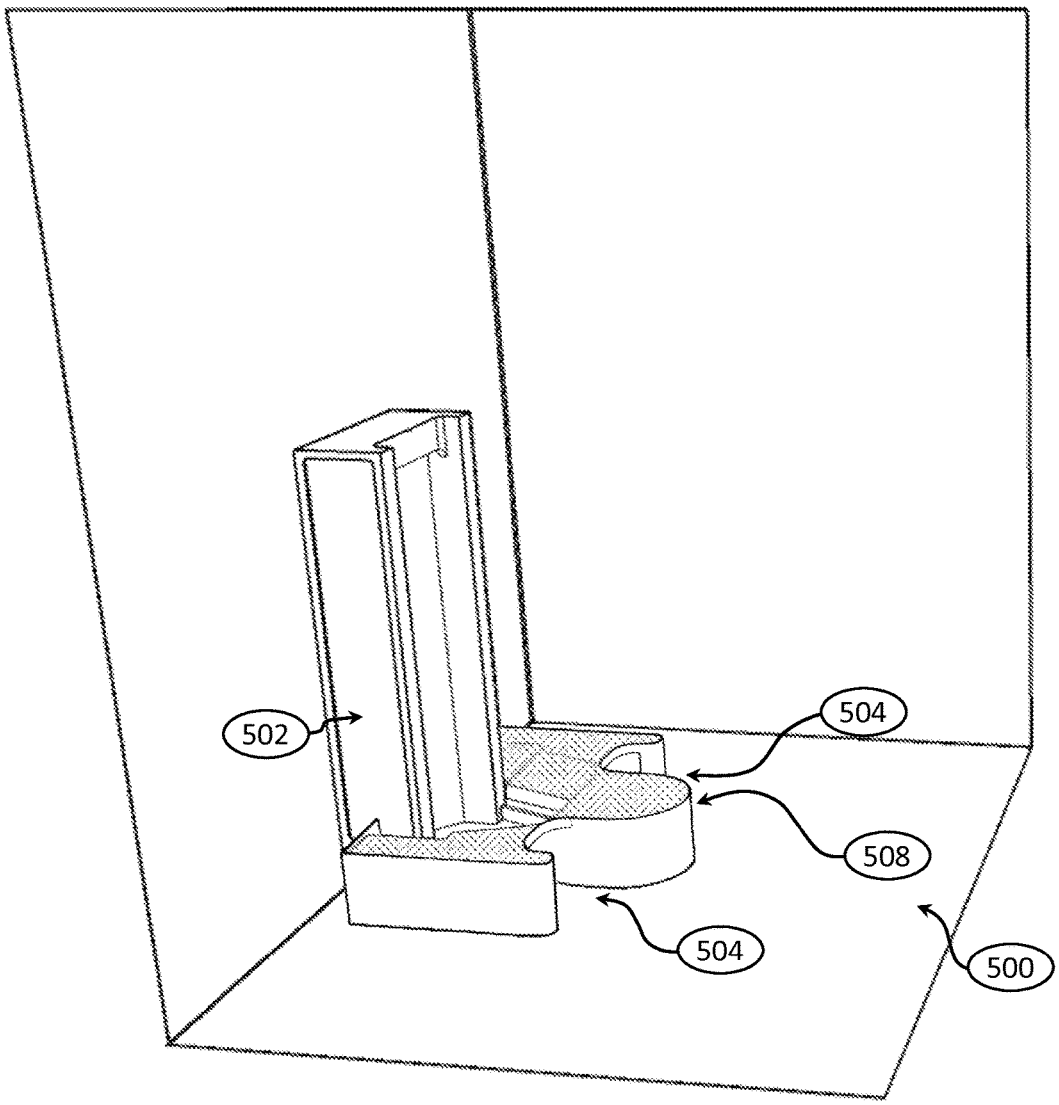
FIG. 5B is a perspective view of the clean-spot apparatus of FIG. 5A.
Figure 5C:
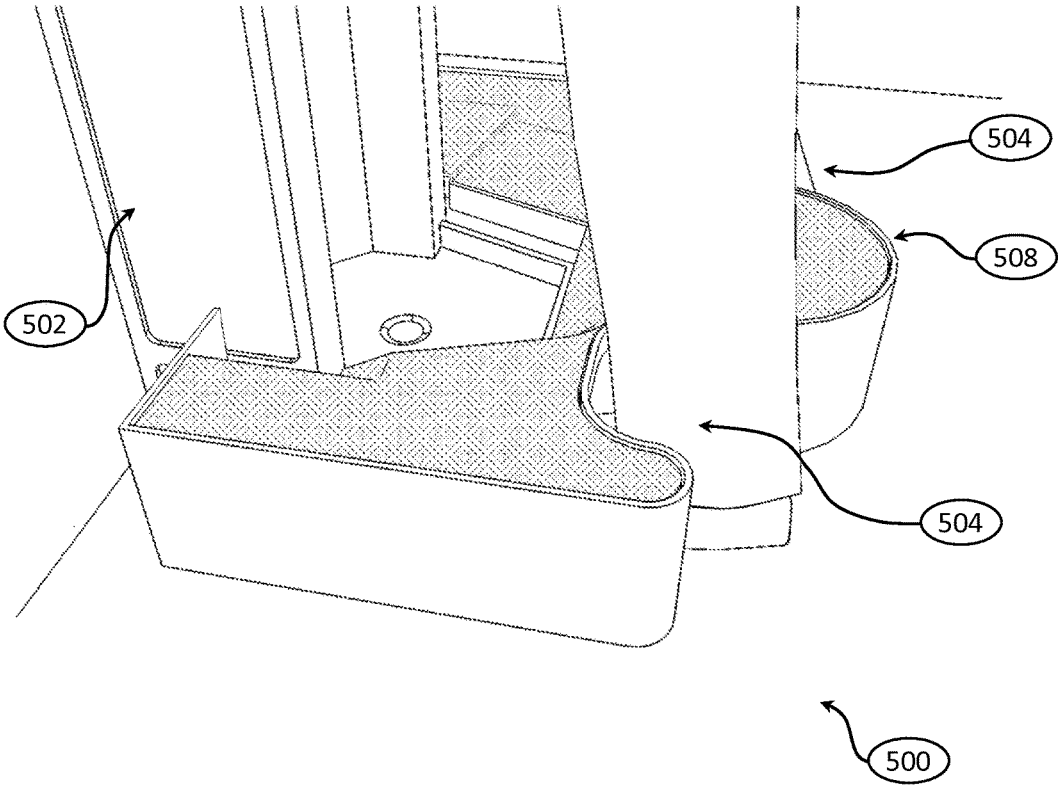
FIG. 5C is a close-up perspective view of the clean-spot apparatus of FIG. 5A.

The clean-spot apparatus 500 can include a pair of recessed areas 504, an extended portion 508, an elevated platform 512, a support structure 516, and a cutout portion 520. The recessed areas 504 can be formed on separate ends of a forwardly-facing side of the elevated platform 512 and can define a substantially concave shape. The forwardly-facing side can be opposed to a rearwardly-facing side of the elevated platform 512. The rearwardly-facing side can be in engagement with the restroom wall. The recessed areas 504 can be dimensioned to receive a person's feet thereby enabling the person to stand close to the floor level urinal 502 and covering the person's feet with the elevated platform 512. The elevated platform 512 can include an upper surface that when the clean-spot apparatus 500 is arranged in a usage position, as shown in FIGS. 5A and 5B, the upper surface can be arranged substantially parallel to the restroom floor. The elevated platform 512 can enable the clean-spot apparatus 500 to intercept splashing/dripping urine while keeping the person's feet and the restroom floor clean. The elevated platform 512 can also include ramped portions 524 ramping downwardly from the elevated platform 512 towards the lower portion of the floor level urinal 502. The ramped portions 524 can direct any splashing/dripping urine towards the lower portion of the floor level urinal 502. The extended portion 508 can be arranged between the recessed areas 504 on the forwardly-facing side of the elevated platform 512 and can extend forwardly beyond the recessed areas 104. The extended portion 508 can provide a large area between the person's feet for intercepting splashing/dripping urine. The cutout portion 520 can be formed on the rearwardly-facing side of the elevated platform 512 and can be dimensioned to frame the lower portion of the floor level urinal 502. Although the cutout portion 520 in the illustrated non-limiting example is shown faming a lower portion of a floor level urinal, it should be appreciated that the cutout portion 520 could be dimensioned to receive any portion of any restroom receptacle.

The upper surface of the elevated platform 512 can support an absorbent pad 528. The absorbent pad 528 can be configured to conform to the shape of the elevated platform 512 including the ramped portions 524. When the clean-spot apparatus 500 is positioned substantially below the floor level urinal 502, the absorbent pad 528 can intercept splashing/dripping urine before it contacts the restroom floor.

Figure 5D:
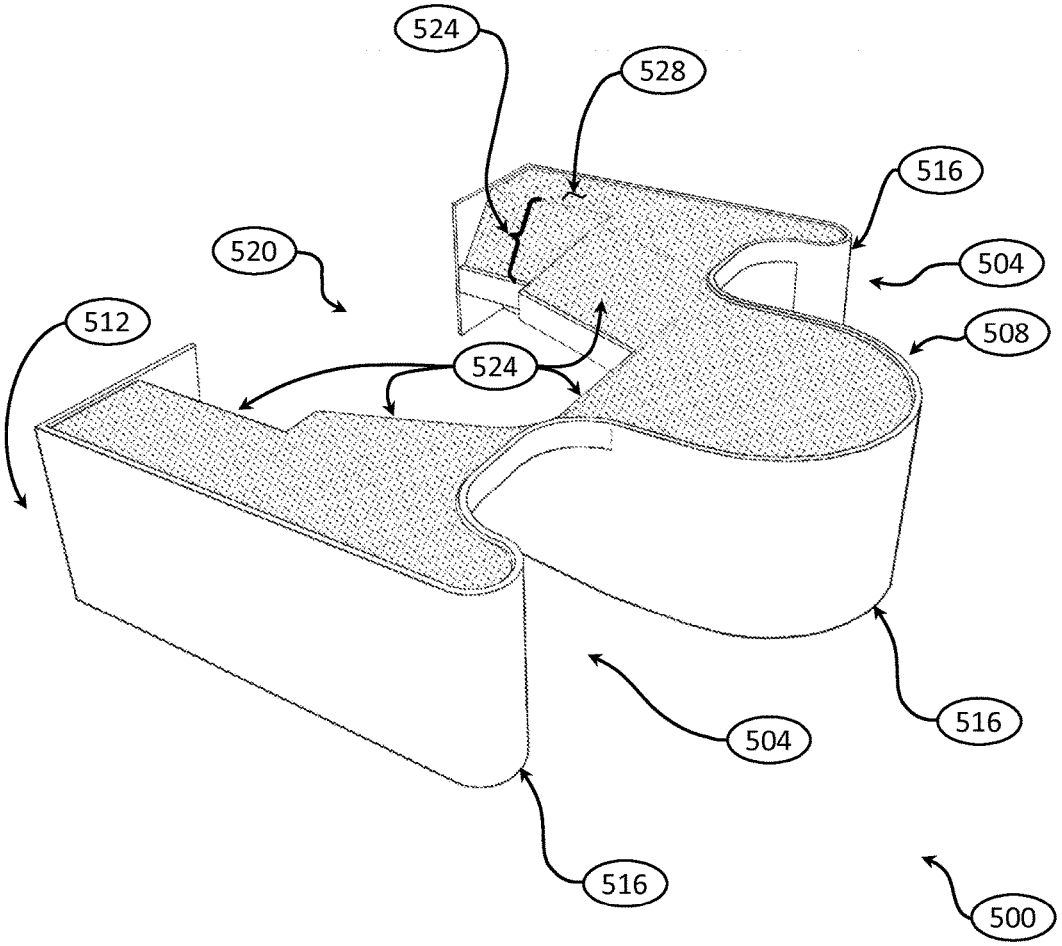
FIG. 5D is a perspective view of the clean-spot apparatus of FIG. 5A.

The elevated platform 512 can be mounted on the support structure 516 that supports the elevated platform 512 above the restroom floor. As shown in FIG. 5D, the elevated platform 512 can be arranged substantially perpendicular to the support structure 516. In the illustrated, non-limiting example, the support structure 516 can support the elevated platform 512 approximately 6 inches above the restroom floor. In other non-limiting configurations, the support structure 516 can support the elevated platform 512 at any distance from the restroom floor, as desired.

The support structure 516 and the elevated platform 512 may be integrally formed as in a monolithic form, or they may be provided by separable components, as desired. The support structure 516 may be a continuous panel section framing the elevated platform 512 or, in other non-limiting configurations, the support structure 516 may include at least one discrete column type support.

The elevated platform 512 and the support structure 516 can be fabricated from a plastic material, for example, a high impact resistant plastic material. In other non-limiting examples, the elevated platform 512 and/or the support structure 516 may be fabricated from any suitable material known in the art. The support structure 516 can include at least one elastic pad (not shown) arranged between support structure 516 and the restroom floor aiding in preventing the clean-spot apparatus 500 from sliding along the restroom floor.

Figure 5E:
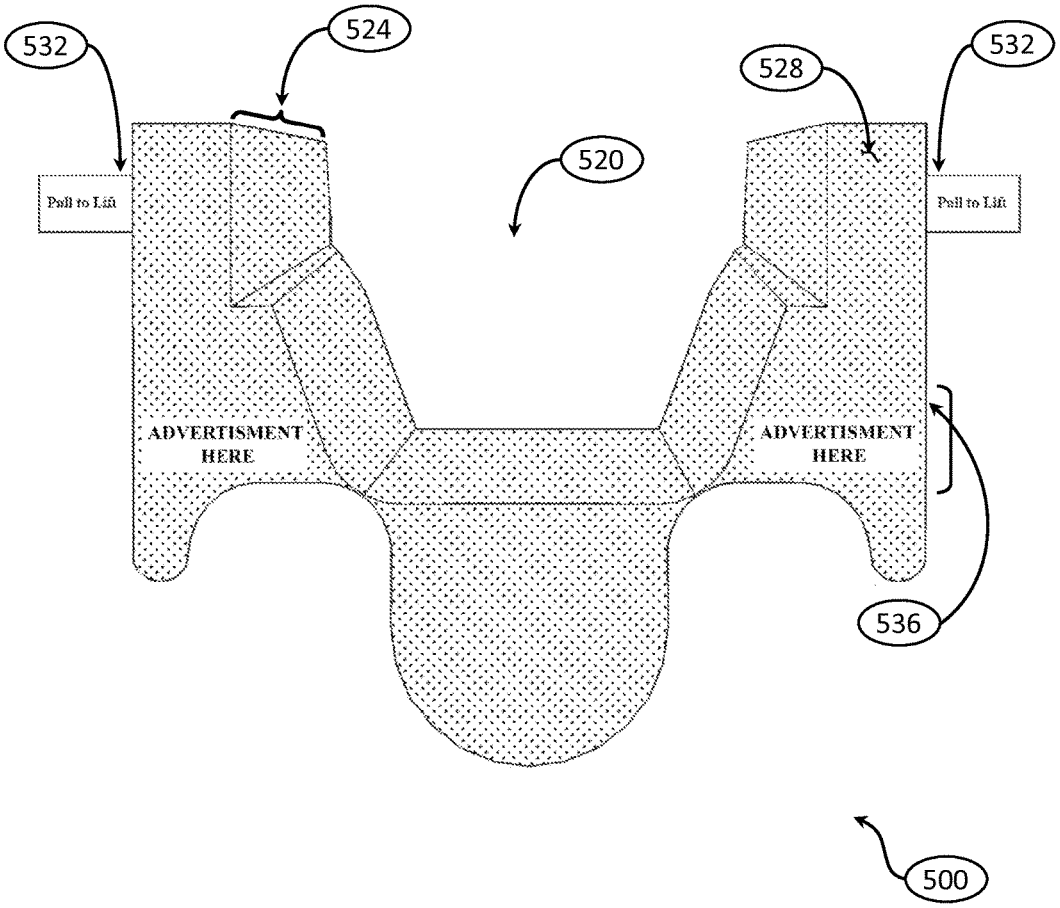
FIG. 5E is a top view of the absorbent pad of the clean-spot apparatus of FIG. 5A.

With reference to FIG. 5E, the absorbent pad 528 can include a pair of lift tabs 532 attached on opposing sides of the absorbent pad 528. The lift tabs 532 may be used to install the absorbent pad 528 onto the elevated platform 512 and/or remove the absorbent pad 528 from the elevated platform 512. A printed advertisement 536 may be displayed on the absorbent pad 528.

The absorbent pad 528 can include an impermeable film (not shown) arranged between the absorbent pad 528 and the elevated platform 512. The impermeable film can provide a seal between the absorbent pad 528 and the elevated platform 512 preventing transmission of fluid onto the elevated platform 512. In one non-limiting example, the absorbent pad 528 may be pre-treated with a deodorizer.

Figure 6A:
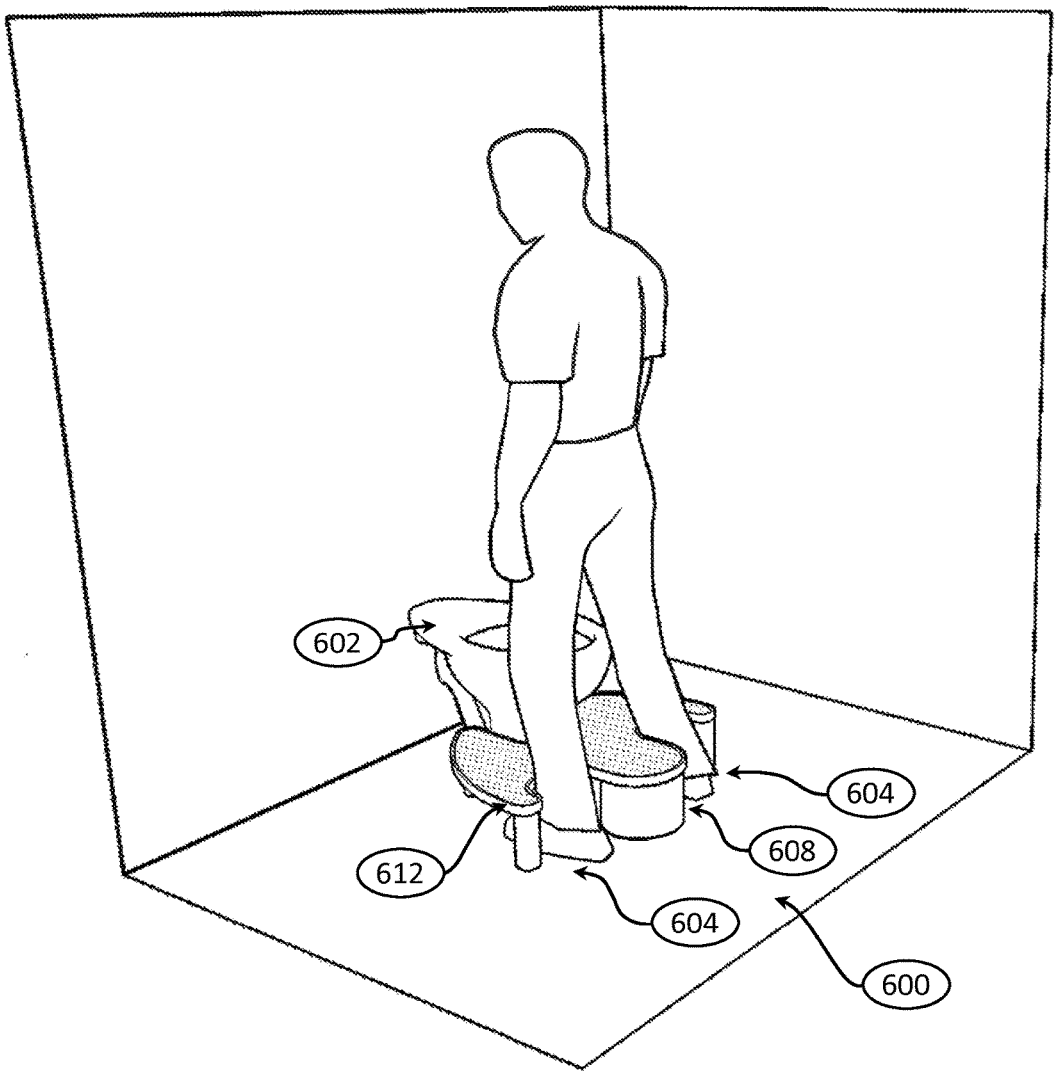
FIG. 6A is a perspective view illustrating a use of a floor-supported clean-spot apparatus with a toilet in accordance with another embodiment of the present disclosure.
Figure 6B:
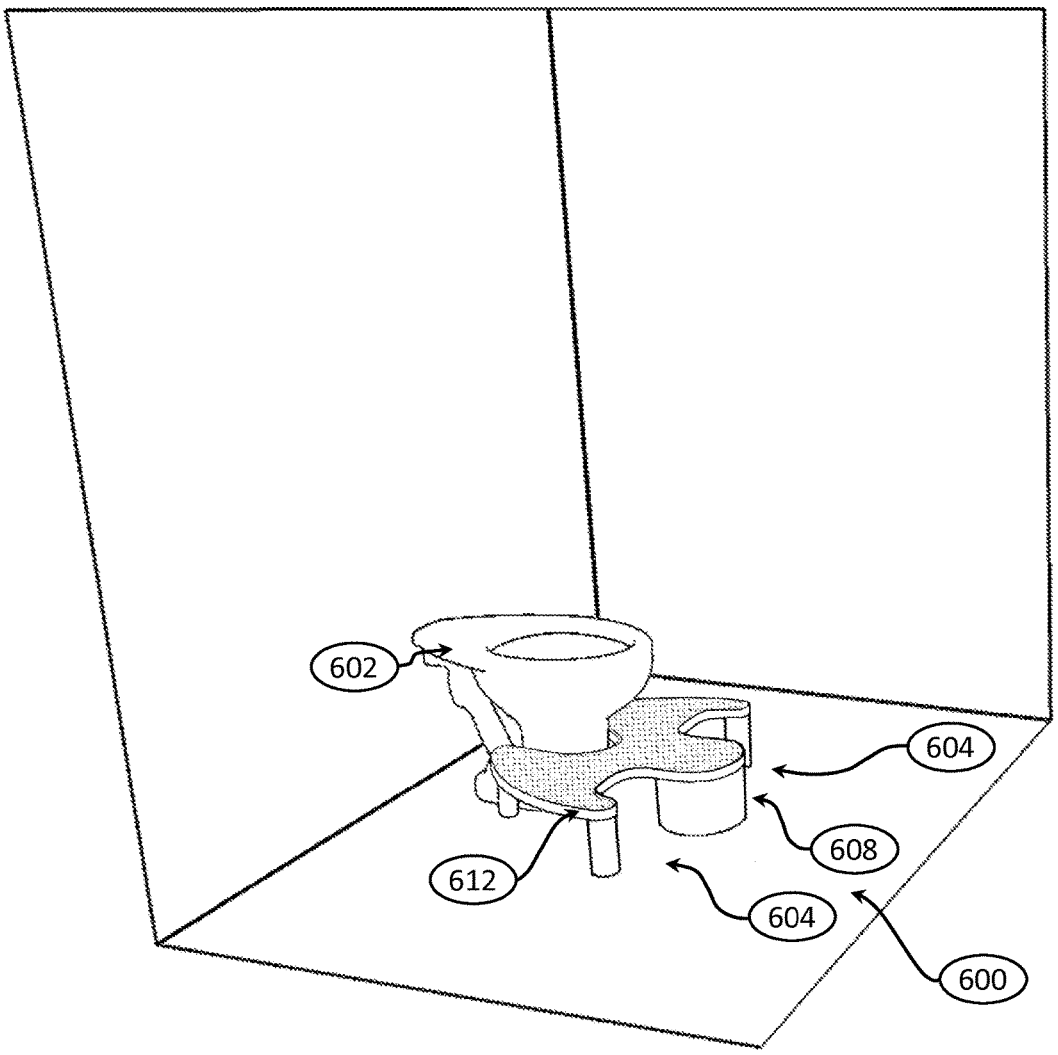
FIG. 6B is a perspective view of the clean-spot apparatus of FIG. 6A.
Figure 6C:
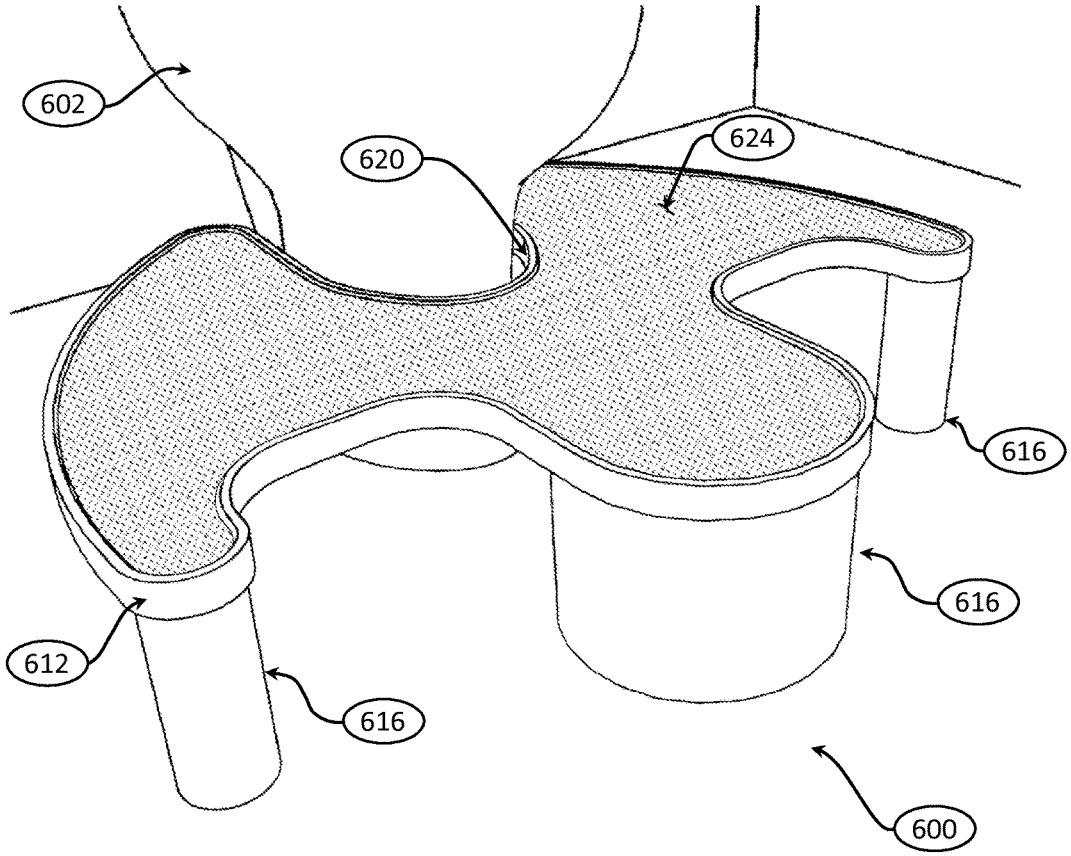
FIG. 6C is a close-up perspective view of the clean-spot apparatus of FIG. 6A.

FIGS. 6A-6D show another non-limiting example of a clean-spot apparatus 600. As shown in FIG. 6A, FIG. 6B, and FIG. 6C the clean-spot apparatus 600 can be configured to be mounted on a restroom floor and received by a lower portion of a toilet 602. Since the clean-spot apparatus 600 can be mounted on the restroom floor, no tools are required for installation, and the clean-spot apparatus 600 can be easily moved for cleaning of the restroom floor.

The clean-spot apparatus 600 can include a pair of recessed areas 604, an extended portion 608, an elevated platform 612, a support structure 616, and a cutout portion 620. The recessed areas 604 can be formed on separate ends of a forwardly-facing side of the elevated platform 612 and can define a substantially concave shape. The forwardly-facing side can be opposed to a rearwardly-facing side of the elevated platform 612. The rearwardly-facing side can be in close proximity or engagement with the toilet. The recessed areas 604 can be dimensioned to receive a person's feet, thereby enabling the person to stand close to the toilet 602 and covering the person's feet with the elevated platform 612. The elevated platform 612 can include an upper surface that when the clean-spot apparatus 600 is arranged in a usage position, as shown in FIGS. 6A and 6B, the upper surface can be arranged substantially parallel to the restroom floor. The elevated platform 612 can enable the clean-spot apparatus 600 to intercept splashing/dripping urine while keeping the person's feet and the restroom floor clean. The extended portion 608 can be arranged between the recessed areas 604 on the forwardly-facing side of the elevated platform and can extend forwardly beyond the recessed areas 604. The extended portion 608 can provide a large area between the person's feet for intercepting splashing/dripping urine. The cutout portion 620 can be formed on the rearwardly-facing side of the elevated platform 612 and can be dimensioned to receive a portion of the toilet 602. Although the cutout portion 620 in the illustrated non-limiting example is shown receiving a portion of a toilet, it should be appreciated that the cutout portion 620 could be dimensioned to receive any portion of any restroom receptacle.

The upper surface of the elevated platform 612 can support an absorbent pad 624. When the clean-spot apparatus 600 is positioned substantially below the toilet 602, the absorbent pad 624 can intercept splashing/dripping urine before it contacts the restroom floor.

The elevated platform 612 can be mounted on the support structure 616 that supports the elevated platform 612 above the restroom floor. As shown in FIG. 6C, the elevated platform 612 can be arranged substantially perpendicular to the support structure 616. In the illustrated non-limiting example, the support structure 616 can support the elevated platform 612 approximately 6 inches above the restroom floor. In other non-limiting configurations, the support structure 616 can support the elevated platform 612 at any distance from the restroom floor, as desired.

The support structure 616 and the elevated platform 612 may be integrally formed as in a monolithic form, or they may be provided by separable components, as desired. In the illustrated non-limiting example, the support structure 616 can include a plurality of discrete column type supports. In other non-limiting examples, the support structure 616 may be a continuous panel section framing the elevated platform 612.

The elevated platform 612 and the support structure 616 can be fabricated from a plastic material, for example, a high impact resistant plastic material. In other non-limiting examples, the elevated platform 612 and/or the support structure 616 may be fabricated from any suitable material known in the art. The support structure 616 can include at least one elastic pad (not shown) arranged between support structure 616 and the restroom floor aiding in preventing the clean-spot apparatus 600 from sliding along the restroom floor.

Figure 6D:
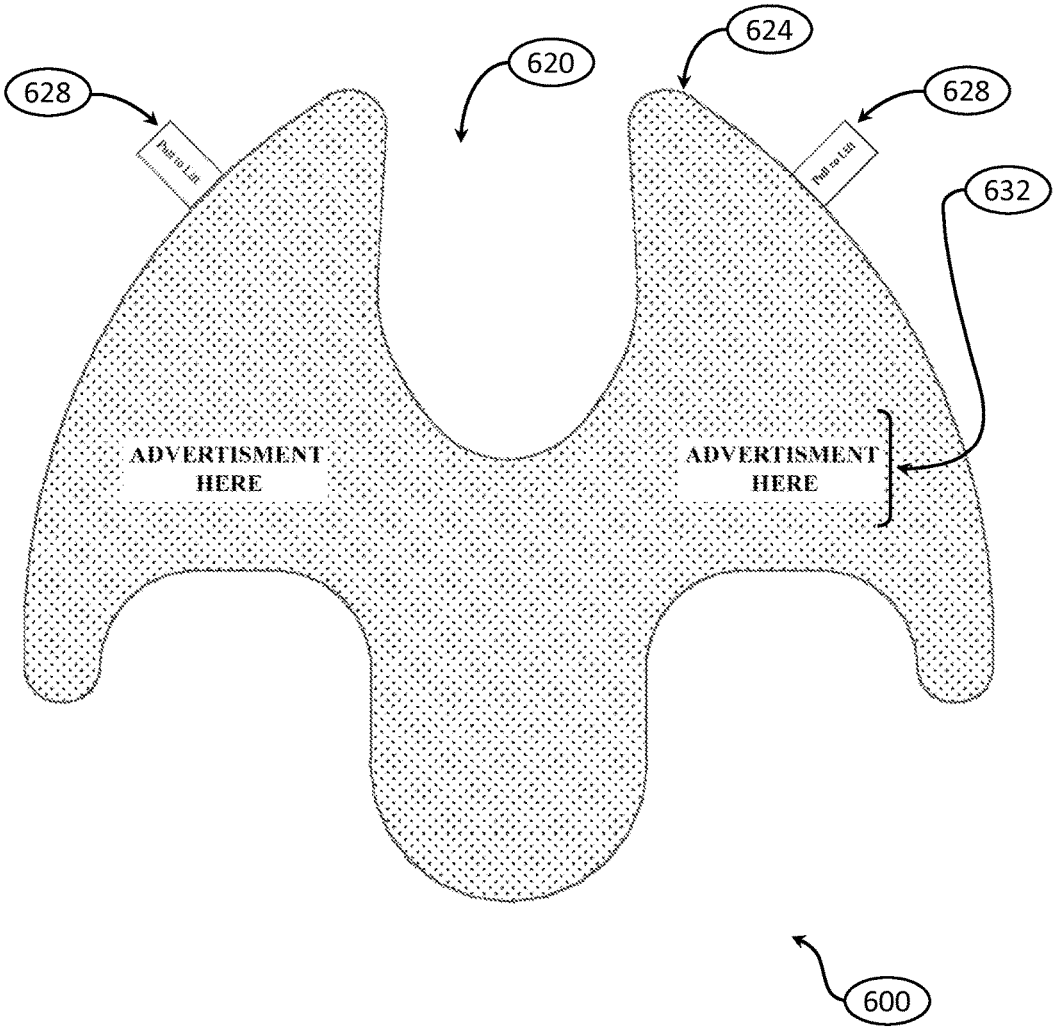
FIG. 6D is a top view of the absorbent pad of the clean-spot apparatus of FIG. 6A.

With reference to FIG. 6D, the absorbent pad 624 can include a pair of lift tabs 628 attached on opposing sides of the absorbent pad 624. The lift tabs 628 may be used to install the absorbent pad 624 onto the elevated platform 612 and/or remove the absorbent pad 624 from the elevated platform 612. A printed advertisement 632 may be displayed on the absorbent pad 624.

The absorbent pad 624 can include an impermeable film (not shown) arranged between the absorbent pad 624 and the elevated platform 612. The impermeable film can provide a seal between the absorbent pad 624 and the elevated platform 612 preventing transmission of fluid onto the elevated platform 612. In one non-limiting example, the absorbent pad 624 may be pre-treated with a deodorizer.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A clean-spot apparatus for improving cleanliness and hygienic conditions in a restroom by covering a person's feet on a restroom floor at a restroom receptacle, the clean-spot apparatus comprising:

an elevated platform supported by a support structure, the elevated platform having an upper surface arranged substantially parallel to the restroom floor when the clean-spot apparatus is positioned in a usage position relative to the restroom receptacle;

an absorbent pad supported by the upper surface of the elevated platform;

the upper surface having a lip formed around a perimeter of the upper surface to receive the absorbent pad; and a pair of recessed areas formed on a forwardly-facing side of the elevated platform with each one of the pair of recessed areas having a respective volume dimensioned to receive the person's feet in which each respective volume is defined by a lower side of the elevated platform on an upper side thereof in conjunction with the support structure on lateral sides thereof;

wherein, when the person approaches the clean-spot apparatus for use of the restroom receptacle and places their feet into the pair of recessed areas, the elevated platform covers and protects their feet and the restroom floor.

2. The clean-spot apparatus of claim 1, further comprising an extended portion arranged between the pair of recessed areas on the forwardly-facing side, the extended portion extending forwardly beyond the recessed areas.

3. The clean-spot apparatus of claim 1, wherein the absorbent pad includes an impermeable film arranged between the absorbent pad and the elevated platform, the impermeable film providing a seal between the absorbent pad and the elevated platform preventing the transmission of fluid onto the elevated platform.

4. The clean-spot apparatus of claim 1, wherein the absorbent pad is pre-treated with a deodorizer.

5. The clean-spot apparatus of claim 1, wherein the absorbent pad includes at least one pull tab attached to the absorbent pad.

6. The clean-spot apparatus of claim 1, further comprising an integrated wall-mounting assembly configured to attach the clean-spot apparatus to a wall and position the elevated platform substantially below the restroom receptacle.

7. The clean-spot apparatus of claim 6, wherein the integrated wall-mounting assembly includes an upper flange, a pair of stiffener gussets, and a wall-bearing panel.

8. The clean-spot apparatus of claim 7, wherein the upper flange is configured to receive at least one fastener element to attach the clean-spot apparatus to the wall.

9. The clean spot apparatus of claim 7, wherein the pair of stiffener gussets extend from the elevated platform to the wall-bearing panel.

10. The clean-spot apparatus of claim 1, further comprising a cutout portion formed on a rearwardly-facing side opposite to the forwardly-facing side, the cutout portion dimensioned to receive the restroom receptacle.

11. The clean-spot apparatus of claim 10, further comprising a support channel arranged along the cutout portion and configured to bond the clean-spot apparatus to the restroom receptacle.

12. The clean-spot apparatus of claim 1, further comprising a cutout portion dimensioned to frame the restroom receptacle.

13. The clean-spot apparatus of claim 12, wherein the elevated platform includes at least one ramped portion ramping from the elevated platform downwardly towards the restroom receptacle.

14. The clean-spot apparatus of claim 1, wherein the elevated platform is arranged substantially perpendicular to the support structure.

15. The clean-spot apparatus of claim 14, wherein the support structure includes at least one discrete column type support.

16. The clean-spot apparatus of claim 14, wherein the support structure is a continuous panel section framing the elevated platform.

17. The clean-spot apparatus of claim 1, wherein the pair of recessed areas each define a substantially concave shape.

18. The clean-spot apparatus of claim 1, wherein the elevated platform and the support structure are fabricated from a plastic material and wherein the plastic material is a high impact resistant material.

19. The clean-spot apparatus of claim 1, further comprising an elastic pad, in which the elastic pad is received on the underside of the support structure for placement between the support structure and the restroom floor.

* * * * *